US011874083B2

(12) United States Patent
Straka et al.

(10) Patent No.: US 11,874,083 B2
(45) Date of Patent: Jan. 16, 2024

(54) AIR GUN

(71) Applicants: Daniel Straka, Clinton, CT (US); Scott Watrous, Uncasville, CT (US)

(72) Inventors: Daniel Straka, Clinton, CT (US); Scott Watrous, Uncasville, CT (US)

( * ) Notice: Subject to any disclaimer, the term of this patent is extended or adjusted under 35 U.S.C. 154(b) by 4 days.

(21) Appl. No.: 17/878,083

(22) Filed: Aug. 1, 2022

(65) Prior Publication Data

US 2023/0036552 A1 Feb. 2, 2023

Related U.S. Application Data

(60) Provisional application No. 63/203,821, filed on Jul. 31, 2021.

(51) Int. Cl.
*F41B 11/00* (2013.01)
*F41B 11/642* (2013.01)
*F41B 11/723* (2013.01)

(52) U.S. Cl.
CPC ..... *F41B 11/642* (2013.01); *F41B 11/723* (2013.01)

(58) Field of Classification Search
CPC ..... F41A 21/10; F41A 11/02; F41A 21/484; F41B 11/62; F41B 11/52; F41B 11/55; F41B 11/721; F41B 11/54; F41B 11/722; F41B 11/723; F41B 11/682
USPC ..... 124/73, 41.1, 45, 49, 63, 71, 72, 74, 76, 124/82, 75, 77
See application file for complete search history.

(56) References Cited

U.S. PATENT DOCUMENTS

| | | | | |
|---|---|---|---|---|
| 5,890,479 | A * | 4/1999 | Morin | F41B 11/57 124/31 |
| 6,637,420 | B2 | 10/2003 | Moritz | |
| 6,874,492 | B1 * | 4/2005 | Schavone | F41B 11/721 124/31 |
| 7,111,621 | B2 | 9/2006 | Lin | |
| 7,730,881 | B1 * | 6/2010 | Pedicini | F04B 35/04 124/65 |
| 7,861,702 | B1 | 1/2011 | Sze | |
| 9,222,748 | B2 | 12/2015 | Macy et al. | |
| 10,132,591 | B2 * | 11/2018 | Sandgren | F41A 9/75 |
| 10,619,969 | B2 | 4/2020 | Lee | |
| 10,801,804 | B2 * | 10/2020 | Sandgren | F41B 11/50 |
| 10,852,093 | B2 | 12/2020 | Monti | |

(Continued)

OTHER PUBLICATIONS

Lord Odin, "How a Tippmann A5 Works", YouTube Video, https://www.youtube.com/watch?v=hyUZrnvt2Zw.

*Primary Examiner* — Michael D David
(74) *Attorney, Agent, or Firm* — Emanus, LLC; Willie Jacques

(57) ABSTRACT

The present invention discloses an air gun. The air gun having a recoil gas unit and a bolt carrier unit. The recoil gas unit comprises a recoil guide tube configured to supply compressed air and a recoil assembly spring for movement of the recoil tube carrier. The bolt carrier unit is coupled to the recoil gas unit and comprises a piston disposed at a first end of the bolt carrier unit. The bolt carrier unit also comprises a valve chamber for performing a firing stroke of the air gun. The bolt carrier unit also comprises a piston chamber integrated at a second end of the bolt carrier unit. The piston chamber is configured to facilitate movement of the piston and to receive the compressed air, for performing a recoiling stroke of the air gun. The recoil gas unit facilitates the firing stroke and the recoiling stroke of the air gun.

15 Claims, 28 Drawing Sheets

(56) References Cited

U.S. PATENT DOCUMENTS

| | | | | |
|---|---|---|---|---|
| 10,955,216 | B2 * | 3/2021 | Pedicini | F41B 11/64 |
| 11,346,634 | B2 * | 5/2022 | Sullivan | F41B 11/721 |
| 2005/0260545 | A1 * | 11/2005 | Schavone | F41B 11/71 434/18 |
| 2014/0137847 | A1 | 5/2014 | Macy | |
| 2015/0176941 | A1 * | 6/2015 | Pullens | F41B 11/55 29/401.1 |
| 2016/0047620 | A1 | 2/2016 | Tseng | |

* cited by examiner

AIR GUN

FIELD OF THE DISCLOSURE

The present invention generally relates to a field of projectile firing assembly, and more particularly relates to an air gun for firing projectiles.

BACKGROUND OF THE DISCLOSURE

Historically, several outdoor games especially survival games or war games had been a sport to relieve stress and provide entertainment. With the advancement of technology, in survival games, weapons or equipment began to be an integral part, either for attack or defence. One such piece of equipment, in the survival games, is a toy gun. Such use of weapons has proved to be highly efficient in relieving stress, especially in the urban population. Further, toy guns which are mainly employed for survival games or war games include airsoft guns, and paintball guns, which fire non-lethal pellets or balls using pressurized air. Currently, the toy guns are mostly driven using mechanical firing or electronic firing means. The mechanical firing means include a trigger for controlling an air passage within the toy gun to fire. It can be noted that for each shot to be fired, the trigger is pulled. However, a user of the mechanical guns cannot pull the trigger fast enough for rapid fires. Further, there are few examples of the toy guns which involve a mechanically actuated rapid-fire such as, fully-automatic paintball markers and many other airsoft mechanical guns. The fully-automatic paintball markers allow full-auto fire due to an internal operation of the fully-automatic paintball markers. However, these fully-automatic paintball markers do not work well in full-automatic operation, due to a number of reasons, such as, but not limited to, a short distance traveled by a hammer which causes extremely rapid fire, while pressure drops quickly, and therefore, the fully-automatic paintball markers no longer cycle fully. Further, the toy guns with the mechanically actuated rapid fire designs tend to use various delay and tuning methods to slow a rate of fire of the toy gun. On the other hand, the electronic firing means include a trigger for controlling an operation of a solenoid valve in the toy gun to fire. Further, the electronic firing means conducts rapid-fire. However, the electronic firing means are prone to any faults in the solenoid valve or the electronics of the toy guns.

In order to overcome the above-mentioned drawbacks of the mechanical firing means and the electronic firing means, air guns are used which have a long variety of mechanisms driven pneumatically. In an example, the air guns may be, but are not limited to, paintball air guns. Further, a few examples of traditional paintball air guns may include, but not limited to, Tippmann 98, Planet Eclipse EGO, and WGP Autococker. However, these traditional paintball air guns do not include a Mag (Magazine) Fed system, and therefore, a user needs to install a separate Mag Fed conversion kit for these traditional paintball air guns. In another example, the paintball air guns having a Mag Fed system, may include, but are not limited to, First Strike T-15, Planet Eclipse MG100, Tippmann TMC, or Carmatech SAR-12. Typically, the paintball air guns take the outside shape of a firearm as a shell and embed a fixed traditional toy gun mechanism within it. Further, such paintball air guns having a fixed valve unit housed within a single primary body that contains all individual subcomponents like a firing pin, a piston, and a bolt. It can be noted that the existing technology of the paintball air guns, works differently when compared to actual firearms. Thus, the existing paintball air guns used for playing the survival games, lack the experience when compared to the actual firearms.

Further, several air gun manufacturers provide military-style air guns, based on various methods of internal operation. However, such military-style air guns have a low-power and are also known as low-power plastic pellet air guns (referred to as airsoft guns). Sometimes, such type of airsoft guns is referred to as Gas Blowback rifles (or GBB rifles). Another such type of airsoft guns is referred to as Automatic Electric Gun (AEG) type. Further, such airsoft guns use some amount of compressed gas, via air valves, for their operation. However, such airsoft guns comprise primary air valves housed within the magazine of the air gun. The use of air valves within the magazine may damage the projectiles within the magazine.

Prior art, for various aspects, contained therewithin, relevant to this disclosure includes, U.S. Patent Application No. US20140137847A1 to Omar Alonso Macy, U.S. Patent No. U.S. Pat. No. 9,222,748B2 to Loc T. Pham, and U.S. Patent Application No. US20160047620A1 to Jui-Fu Tseng.

In particular, reference '847 to Macy discloses a projectile launcher capable of optionally repositioning a bolt to a predefined position using a bolt carrier. The projectile launcher, in one aspect, includes a bolt, a striker, a bolt carrier, and a ramp. The bolt, in one example, is configured to be able to move within a bolt chamber. The striker has a striker reset hook that can move in a direction parallel to a moving direction of the bolt. The bolt carrier, having a fastener, a flexible latch, and a bolt repositioning latch attached to the bolt via the fastener. The flexible latch is able to latch to the striker reset hook, for resetting the striker during the process of launching a projectile. Further, the ramp facilitates disconnecting the flexible latch from the striker reset hook when the flexible latch moves over the ramp. However, unlike the subject matter of the disclosed invention, Macy does not discuss or suggest that the bolt carrier is compact within the bolt chamber and a striker resets a hook, every time for launching a projectile. Furthermore, Macy does not disclose or suggest a moving valve in a recoil assembly of the projectile launcher, which shuts air between the sliding valve, making the bolt assembly of the projectile launcher normalized to ambient air.

Another art '748 to Pham discloses a projectile launcher containing a top-mounted striker launching mechanism capable of propelling a projectile or object. In one aspect, the projectile launcher includes a bolt, a valve, and a striker. The bolt containing an air channel and a bolt carrier is situated inside a receiver of the projectile launcher. The bolt is used to facilitate the launch of a projectile. Further, the valve which is situated inside the receiver above a firing chamber away from the ground, is operable to control the release of pressurized gas for propelling the projectile. The striker which is coupled to the bolt via the bolt carrier and is physically situated above the bolt away from the ground, is able to strike a valve pin of the valve to release a predefined amount of pressurized gas for propelling the projectile from the firing chamber to a target. Further, the recoil action of the projectile launcher has a separate mechanism or valve which therefore restricts the motion of the bolt carrier. However, unlike the subject matter of the disclosed invention, Pham does not discuss or suggest the aspect that the pressure chamber situated therein provides only a predefined amount of gas. Further, Pham does not disclose or suggest that a bolt carrier of the projectile launcher has a moving valve during the recoiling action of the air gun.

Another art '620 to Tseng discloses an automatic air rifle which includes a front sliding sleeve including upper and lower recesses. The automatic air rifle also includes a main biasing member secured to the front sliding sleeve and the charging handle respectively along with a roller. Further, the automatic air rifle includes an L-shaped rod; a rear diversion channel through the front sliding sleeve. Further, the automatic air rifle includes a rear sliding sleeve including pivotal upper and lower hooks, a main tube through the rear sliding sleeve and including a rear inlet, and an annular flange proximate the rear inlet. The automatic air rifle also includes a gas piston disposed forwardly of the main tube; an inlet member at a rear end of the gas piston; and an auxiliary biasing member put on the main tube and biased between the front sliding sleeve and the rear sliding sleeve. The air rifle is capable of firing in a semi-automatic or fully automatic position. However, unlike the subject matter of the disclosed invention, Tseng does not discuss or suggest the aspect that the rifle is completely automatic. Further, Tseng does not disclose or suggest that the bolt carrier is compact and does not provide a recoiling and resetting action in a single blow.

The current market solutions for air gun replicas, all involve taking toy gun mechanisms and dressing them up superficially to outwardly resemble some type of actual firearms. Therefore, in the light of the above discussion and existing air guns, there is a need to develop an automatic air gun primarily to be used in the sport of the survival games like paintball, which resembles the outer structure as well as the inside functioning of the air gun to be similar to an actual firearm.

SUMMARY OF THE DISCLOSURE

An air gun for firing projectiles is disclosed. The air gun comprises a recoil gas unit and a bolt carrier unit. The recoil gas unit comprises a recoil guide tube configured to supply compressed air. Further, the recoil gas unit comprises a recoil assembly spring, wrapped around the recoil guide tube and disposed within a recoil tube carrier, for the movement of the recoil tube carrier. Further, the recoil gas unit is coupled to the bolt carrier unit. The bolt carrier unit comprises a piston disposed at a first end of the bolt carrier unit. The bolt carrier unit also comprises a piston chamber integrated at a second end of the bolt carrier unit, between a cap of the bolt carrier unit and the piston. The bolt carrier unit comprises a valve chamber integrated within the piston of the bolt carrier unit. Further, the valve chamber is a space between a first end of the piston and a second end of the piston. Further, the valve chamber is configured to facilitate movement of the piston and to receive the compressed air, for performing a firing stroke. Further, the compressed air contained within the valve chamber acts to perform the firing stroke and then retard movement of the piston some amount before the recoil stroke is executed.

In one embodiment, the recoil gas unit facilitates the compressed air to flow towards the valve chamber of the bolt carrier unit, to facilitate the firing stroke and the recoiling stroke of the air gun. The valve chamber is configured to continuously retain the compressed air during the movement of the piston, towards the barrel of the air gun, to move the valve chamber rearwards and to release a shut-off valve. Further, the valve chamber is designed to retain the received compressed air at all times, when the valve chamber is at a first position, such as, at rest position or during forward movement. Further, the valve chamber is configured to release the compressed air at a second position and the compressed air flowing towards the valve chamber is shut off. Further, the recoil gas unit comprises a shut-off valve, disposed along a length of the recoil guide tube. The shut-off valve is configured to hinder the compressed air being delivered to the valve chamber. In one embodiment, the recoil gas unit comprises a flow reduction mechanism to achieve a sufficient pressure differential to cycle the air gun. Further, the flow reduction mechanism may be used to hinder the compressed air being delivered to the valve chamber. Further, the flow reduction mechanism may comprise a narrow orifice to restrict flow of the compressed air. Further, the supply of compressed air to the bolt carrier unit is removed at an end of the recoil stroke, allowing the bolt carrier unit to reset after firing. Further, when the compressed air continues to flow freely from a rest position of the air gun, the air gun fires once and then stays in a recoiled position slowly venting the compressed air through a plurality of bleed holes until retained compressed air is removed. Such an assembly of the air gun facilitates the use of a limited supply of compressed air, for the firing and recoiling stroke, while firing the projectile.

Further, the bolt carrier unit comprises a firing pin integrated at the second end of the bolt carrier unit. The firing pin is actuated by a hammer retained by a trigger of the air gun. The bolt carrier unit also comprises a retainer coupled to the cap of the bolt carrier unit and the firing pin. In one embodiment, the retainer may be installed on the firing pin itself. In another embodiment, an e-clip retainer may be incorporated on the firing pin. The retainer is configured to hold the firing pin from falling out of the bolt carrier unit. Further, such usage of the retainer prevents the firing pin from loosening, due to repeated actuation by the hammer.

In one embodiment, the piston comprises a piston head at the first end of the piston and a valve pin coupled with the piston head, at the second end of the piston. The piston further comprises a valve pin spring wrapped around the valve pin. The valve pin, and the valve pin spring are configured to move towards a barrel of the air gun to release air after the firing stroke is completed. The piston head is further configured to move within the bolt carrier unit during the firing stroke of the air gun. Further, the second end of the piston is sealed by the valve pin. Further, the bolt carrier unit comprises a bolt coupled at the second end of the piston. Further, the bolt is configured to be pushed forward against the barrel, causing the bolt carrier unit to move rearwards and the bolt is configured to be pulled rearwards by recoiling action of the bolt carrier unit. The bolt provides compactness to the second end of the piston and is further configured to project the compressed air released from the valve chamber to eject projectile from the air gun. Further, the compressed air is released from the valve chamber, and fed into the piston chamber to initiate a recoiling action or recoil stroke of the bolt carrier unit.

In one embodiment, the recoil assembly spring is configured to push the bolt carrier unit forward to a resetting position, when the recoil stroke is completed. The recoil assembly spring is further configured to decompress to an initial length when the bolt carrier unit moves forward to the resetting position. Further, during a firing operation of the air gun, the trigger is actuated by an operator of the air gun. The air gun is configured for an automatic function, by recharging the hammer during a rearward movement of the bolt carrier unit at the end of the recoiling stroke.

In one embodiment, the bolt carrier unit further comprises a check valve integrated on a side air passage of the bolt carrier unit. Further, the check valve may act a passage integrated between the recoil gas unit and the valve chamber. The bolt carrier unit is configured to prevent the compressed air from venting out of the valve chamber. The ball check valve is further configured to retain the compressed air within the valve chamber, when the bolt carrier unit is manually charged or pulled rearwards to load or unload the air gun. The bolt carrier unit further comprises a recoil piston return spring placed between the piston and a forward end of the piston chamber. Further, the recoil piston return spring is configured to sit between the piston and a forward end of the piston chamber, to return the piston to a rearward position after the recoiling stroke is completed. The piston chamber is configured to facilitate a recoiling action of the bolt carrier unit when the compressed air is fed into the piston chamber during an initial stage of recoil stroke. Further, the compressed air supplied from the recoil gas tube unit and then into the recoil tube carrier, past the check valve, moves into that piston chamber. Further, the piston chamber is diverted rearwards by the forward movement of the valve pin which forms a pressurized chamber. Such air gun resembles the actual firing equipment (like AK-47) for the operation performed with the help of the recoil gas unit and the bolt carrier unit.

These and other examples of the invention will be described in further detail below.

BRIEF DESCRIPTION OF THE DRAWINGS

The accompanying drawings illustrate various embodiments of systems, methods, and embodiments of various aspects of the disclosure. Any person of ordinary skill in the art will appreciate that the illustrated element boundaries (e.g., boxes, groups of boxes, or other shapes) in the figures represent one example of the various boundaries representative of the disclosed invention. It may be that in some examples one element may be designed as multiple elements or that multiple elements may be designed as one element. In other examples, an element shown as an internal component of one element may be implemented as an external component in another, and vice versa. Furthermore, elements may not be drawn to scale. Non-limiting and non-exhaustive descriptions of the present disclosure are described with reference to the following drawings. The components in the figures are not necessarily to scale, emphasis instead being placed upon the illustrated principles.

Various embodiments will hereinafter be described in accordance with the appended drawings, which are provided to illustrate and not to limit the scope of the disclosure in any manner, wherein similar designations denote similar elements, and in which.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Some embodiments of this disclosure, illustrating all its features, will now be discussed in detail. The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context dictates otherwise. Although any number of systems and methods similar or equivalent to those described herein can be used in the practice or testing of embodiments of the present disclosure, the preferred systems, and methods are now described.

Embodiments of the present disclosure will be described more fully hereinafter with reference to the accompanying drawings in which like numerals represent like elements throughout the several figures, and in which example embodiments are shown. Embodiments of the present disclosure may, however, be embodied in alternative forms and should not be construed as being limited to the embodiments set forth herein. The examples set forth herein are non-limiting examples and are merely examples among other possible examples.

Figure 1A:
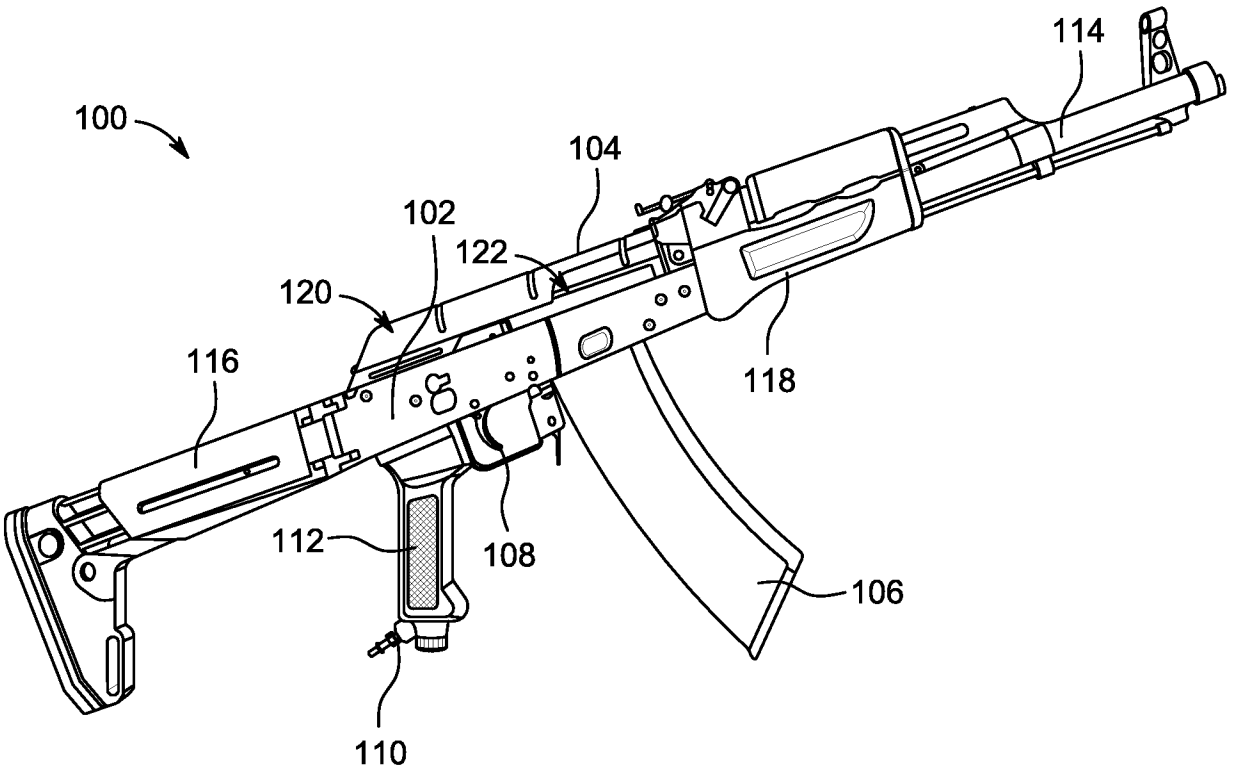
FIGS. 1A and 1B illustrate an overview of an air gun, according to an embodiment of the present disclosure.

FIG. 1A illustrates an overview of an air gun 100, according to an embodiment of the present disclosure. FIG. 1A is described in conjunction with FIG. 1B.

In one embodiment, the air gun 100 may be a replica of traditional firearms such as AK-47 or AK-M type. The air gun 100 may comprise a housing 102, a cover 104, a magazine 106, a trigger 108, an air inlet swivel 110, a handle 112, a barrel 114, a buttstock 116, and a handguard 118. The housing 102 may enclose a recoil gas unit 120 and a bolt carrier unit 122. It can be noted that the recoil gas unit 120 and the bolt carrier unit 122 together perform various operations of the air gun 100. Further, the recoil gas unit 120 may be coupled to the bolt carrier unit 122. In one embodiment, the bolt carrier unit 122 may be referred as a recoiling element, as the bolt carrier unit 122 may be configured to perform, a recoiling action by the moving between a first position to a second position within the housing 102. In one embodiment, the bolt carrier unit 122 may be referred to as a bolt carrier assembly and the recoil gas unit 120 may be referred to as a recoiling assembly.

At first, the housing 102 may be provided with the cover 104 to protect the recoil gas unit 120 and the bolt carrier unit 122 from air intake or dust. It can be noted that the cover 104 may be detachably coupled to the housing 102. Further, the cover 104 may be made from a material selected from a group of materials such as, but not limited to, stainless-steel, polymer, carbon fiber, plastic, metal, or alloy. In one embodiment, the cover 104 and the housing 102 may be made of the same material. Further, the air gun 100 includes the magazine 106 for storing projectiles. In one embodiment, the air gun 100 may use a plurality of forms of feeding projectiles via the magazine 106, such as, but not limited to, a spring tube feed, a gravity feed from a hopper, a belt feed, or a force feed system that uses electronic, mechanical, or pneumatic actuation to feed projectiles into the air gun 100. It can be noted that the magazine 106 may be detachably coupled to the housing 102 of the air gun 100, as shown in FIG. 1A. In one embodiment, the magazine 106 may be detachably attached to the air gun 100, for holding the magazine 106 firmly into the air gun 100. In another embodiment, the magazine 106 may be spring-loaded and may be coupled to the air gun 100, by pushing the magazine 106 into a chamber of the air gun 100 and may be detached from the air gun 100 by simply pushing a spring forward or manipulating a retention lever. Further, the magazine 106 may be made from a material selected from a group of materials such as, but not limited to, stainless-steel, polymer, carbon fiber, plastic, metal, alloy, etc. In one embodiment, the magazine 106 and the housing 102 may be made of the same material.

Further, the magazine 106 may hold a pre-defined number of projectiles. In one exemplary embodiment, the magazine 106 holds 20 projectiles. Further, the magazine 106 may facilitate automatic reloading of the air gun 100. It can be noted that the use of the magazine 106 reduces the time and need to re-load the air gun 100 manually, each time a projectile is fired from the air gun 100. Further, the size of the projectile may be based on the dimensions of the air gun 100 and the dimensions of the magazine 106. In one embodiment, the projectiles may be made from a material selected from a group of materials from stainless-steel, polymer, carbon fiber, plastic, metal, alloy, etc. In one exemplary embodiment, the projectiles may be paintballs and the air gun 100 may be a paintball air gun, being used in the game of paintball. The projectile can also be referred to as an object, such as, but not limited to, paintball, non-lethal projectile (such as pepper balls), lead or plastic pellets of various calibers, shooting foam darts, or foam-balls, a less-lethal projectile, and/or lethal projectile. For example, a non-lethal projectile can be a food-color based paintball, and a lethal projectile can be a bullet. It should be noted that the terms "paintball," "non-lethal projectile," "less-lethal projectile," and "lethal projectile" will be used interchangeably herein.

Figure 1B:
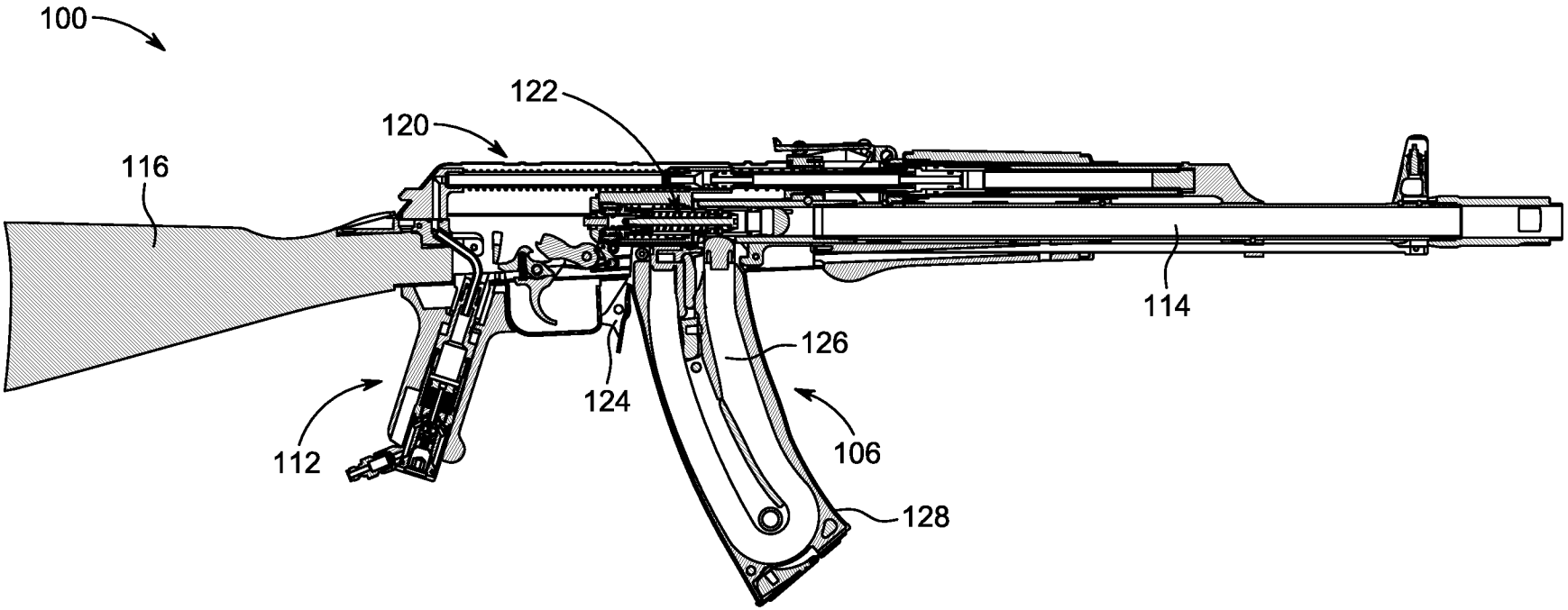

In one embodiment, as shown in FIG. 1B, the magazine 106 may be detachable from the air gun 100 using a magazine release lever 124. In an embodiment, the magazine 106 may be provided with a magazine catch, which is configured to properly lock in the magazine 106 when inserted into the air gun 100. Further, the magazine 106 may comprise an inner structure 126 and an outer structure 128. Further, the outer structure 128 may be frame made of metal such as sheet metal or plastic. The inner structure 126 may comprise a spring and a spring follower. Further, the spring may be configured push a projectile forwards and the spring follower may eject the projectile out of the inner structure 126 of the magazine towards a barrel feed port (not shown) of the barrel 114. In one embodiment, the magazine 106 may use the spring and the spring follower within the inner structure 126 to push the plurality of projectiles into the air gun 100.

In one embodiment, the air gun 100 further comprises the trigger 108 coupled to the housing 102 of the air gun 100. It can be noted that the trigger 108 may be disposed between the handle 112 and the magazine 106 of the air gun 100. Further, the trigger 108 may be actuated to allow an operator of the air gun 100, to control a firing operation of the air gun 100. In one embodiment, the trigger 108 may be manually actuated. In one exemplary embodiment, the manual actuation of the trigger 108 may be initiated by pulling the trigger 108 backward. Further, the trigger 108 may allow the operator to initiate a mechanism or operation of the air gun 100, when a trigger 108 is actuated by the operator. It can be noted that the trigger 108 may allow the operator to fire the projectile from the air gun 100. Further, the trigger 108 may be of a suitable shape, to allow the operator of the air gun 100, to comfortably rest his/her finger on the trigger 108. In one embodiment, the trigger 108 may be made from a material selected from a group of materials such as, but not limited to, stainless-steel, polymer, carbon fiber, plastic, metal, alloy, etc. In another embodiment, the trigger 108 and the housing 102 may be made of the same material.

In one embodiment, the air gun 100 comprises the air inlet swivel 110 which may be disposed at a lower end of the air gun 100. In one embodiment, the air inlet swivel 110 may be integrated within the handle 112. The air inlet swivel 110 may be herein referred to as an air flow guiding element. Further, the air inlet swivel 110 may be connected to a compressed air flow unit or an external air compressor. In one embodiment, the compressed air flow unit may be an air pressure vessel or an air tank. The air inlet swivel 110 may be configured to supply a stream of compressed or pressurized gas or air to launch a projectile such as a paintball, through the air gun 100. Further, the air inlet swivel 110 may be coupled with a means to supply air at a predefined pressure into the recoil gas unit 120 within the housing 102, via the handle 112. It can be noted that the recoil gas unit 120 may receive compressed air from the air inlet swivel 110, via an external air supply. The air supply may be attached to the air gun 100, via the air inlet swivel 110. In one embodiment, the air supply may bypass the handle 112 entirely. In one exemplary embodiment, the air supply may be attached to the buttstock 116 of the air gun 100. The air pressure may be supplied into the recoil gas unit 120 and thereby into the bolt carrier unit 122, to perform the firing operation (as described below) of the air gun 100. Further, the trigger 108 may be actuated to prepare the bolt carrier unit 122 to eject the projectile when the air pressure is fed from the air inlet swivel 110, out of the air gun 100 towards a target. It can be noted that air inlet swivel 110 may be shaped to easily attach to an external air supply. Further, the air inlet swivel 110 may be coupled to an external air supply, using an adapter (not shown). The air inlet swivel 110 may be made from a group of materials such as stainless-steel, polymer, carbon fiber, plastic, metal, alloy, etc. Such use of the air inlet swivel 110 may allow the use of a fixed supply of air to fire the projectile, to reduce the amount of energy loss from air charge for firing the projectile.

In one embodiment, the handle 112 may allow an operator of the air gun 100, to hold the air gun 100. The handle 112 may be made from a material selected from a group of materials such as, but not limited to, stainless-steel, polymer, carbon fiber, plastic, metal, alloy, etc. In another embodiment, the handle 112 and air gun 100 may be made of the same material. In one embodiment, the handle 112 may be provided with an additional grip, which allows firm hold of the air gun 100 by the user. In one embodiment, the grip may be an outer layer on the handle 112, which provides an anti-slip hold to the user. The grip may be made from an elastic material such as rubber, or may be carved into the material of the handle 112.

In one embodiment, the air gun 100 comprises the barrel 114 that allows the projectile to be ejected from the air gun 100, towards the target. It can be noted that a first end of the barrel 114 may be connected to the housing 102 and the second end of the barrel 114 may be set free, from where the projectile ejects. Further, the first end of the barrel 114 may be configured to receive the projectile, when pushed forward during the recoil stroke. The barrel 114 may be a straight shooting tube, usually made of rigid high-strength metal, through which a contained rapid expansion of high-pressure gas(es) is used to propel the projectile out of the air gun 100. In one embodiment, the barrel 114 may comprise a muzzle (not shown) connected to the second end of the barrel 114. It can be noted that precision matching of the muzzle is crucial to accuracy, as it is the last point of contact between the barrel 114 and the projectile. Further, it can also be noted that the barrel 114 may incorporate rifling or other treatment to affect the projectile for greater accuracy or range.

In one embodiment, the air gun 100 includes the buttstock 116 that may be referred to as a back handle or telescoping stock. Further, the buttstock 116 may be detachably coupled from the air gun 100. The buttstock 116 may be coupled to a rear end of the air gun 100, as shown in FIG. 1. It can be noted that the length of the buttstock 116 may be increased or decreased depending upon the requirements of the operator or the arm length of the operator. Further, the buttstock 116 may be expandable, to readily adjust the length of the air gun 100. In one embodiment, the length of the buttstock 116 may be increased by simply pulling the buttock part of the buttstock 116 away from the air gun 100 and the length of the buttstock 116 may be decreased by pushing the buttock part and contracting the buttstock 116. The buttstock 116 may be made from any material including stainless-steel, polymer, carbon fiber, plastic, metal, alloy, wood, etc. In another embodiment, the buttstock 116 and the housing 102 may be made of the same material. It can be noted that mostly a lightweight material is selected, such as polymer or carbon fiber, which facilitate handling the recoil of the air gun 100. In one exemplary embodiment, a MAGPUL Zukhov stock is installed in the air gun 100.

In one embodiment, the air gun 100 comprises the handguard 118 disposed around the barrel 114 of the air gun 100. In one embodiment, the handguard 118 may be a pair of pieces with a first piece wrapped around a lower section of the barrel 114 and a second piece wrapped around an upper section of the barrel 114. In another embodiment, the handguard 118 may be a single piece wrapped around the barrel 114. The handguard 118 may be provided to hold the air gun 100 while firing projectiles. In one exemplary embodiment, a right hand operator while using the air gun 100, holds the handle 112 into the right hand with a forefinger resting on the trigger 108, and the handguard 118 may be held by the left hand of the operator. In one embodiment, the handguard 118 may be made from materials that are light in weight and are good absorbers of sound. The handguard 118 may facilitate in reducing the sound or noise produced during the firing of projectiles and recoiling of the air gun 100. In one exemplary embodiment, the handguard 118 may be made from a material selected from a group of materials such as, but not limited to, wood, polymer, plastic, carbon fiber, or any metal. In one embodiment, the handguard 118 may be made of a sheet metal with perforations, to dissipate heat of the air gun 100.

The housing 102 of the air gun 100 may be covered with a main body made from any possible lightweight material such as wood, carbon fiber, polymer, etc. Further, all the components or parts of the air gun 100 herein disclosed may be made from materials selected from a group of materials of steel, polymer, wood, carbon fiber, etc. without departing from the scope of the disclosure. It may be apparent to one skilled in the art, that the air gun 100 may comprise some other elements as well, apart from the above disclosed elements.

Figure 2A:
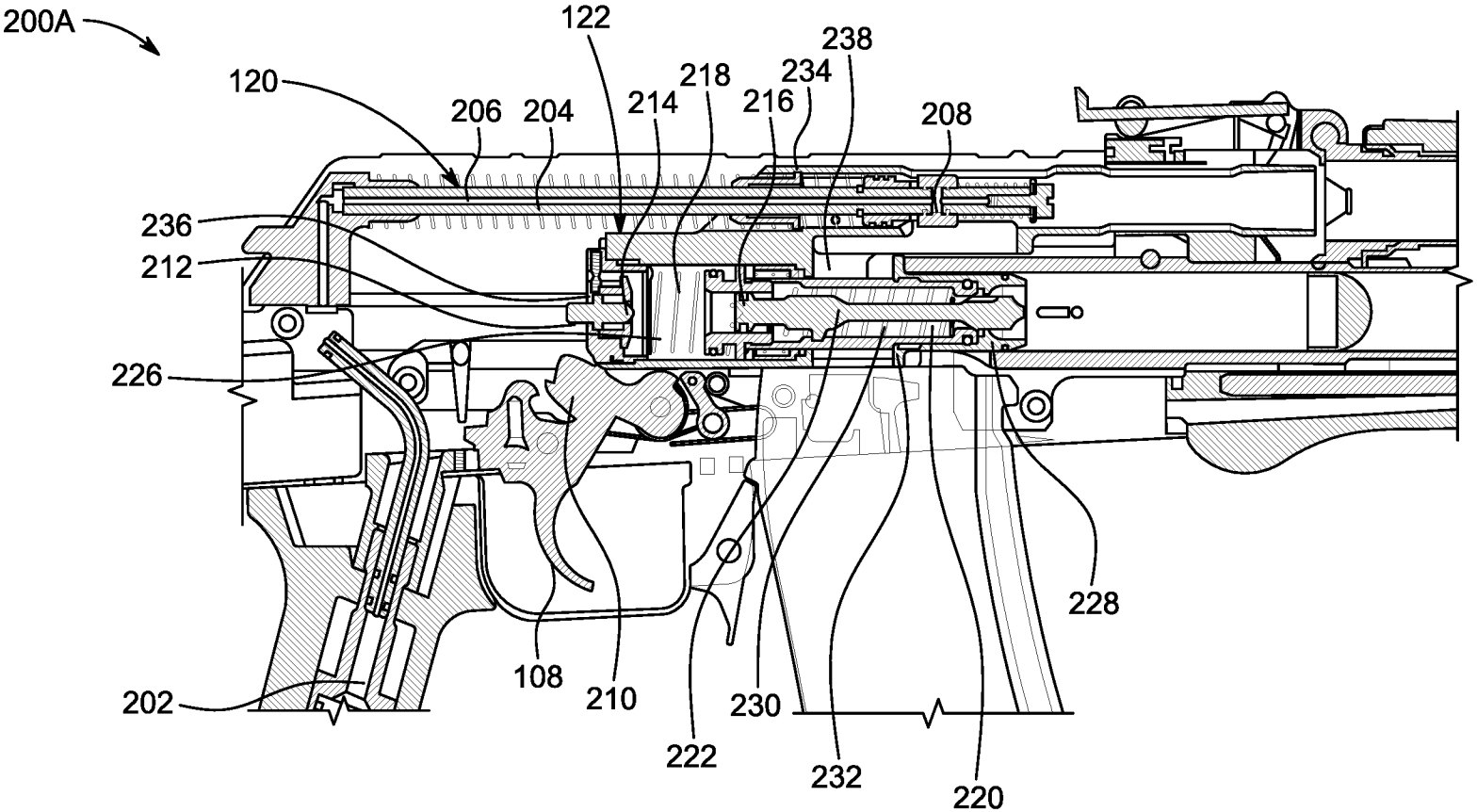
FIG. 2A illustrates a sectional view of the air gun in a partial recoiling position, according to an embodiment of the present disclosure.
Figure 2B:
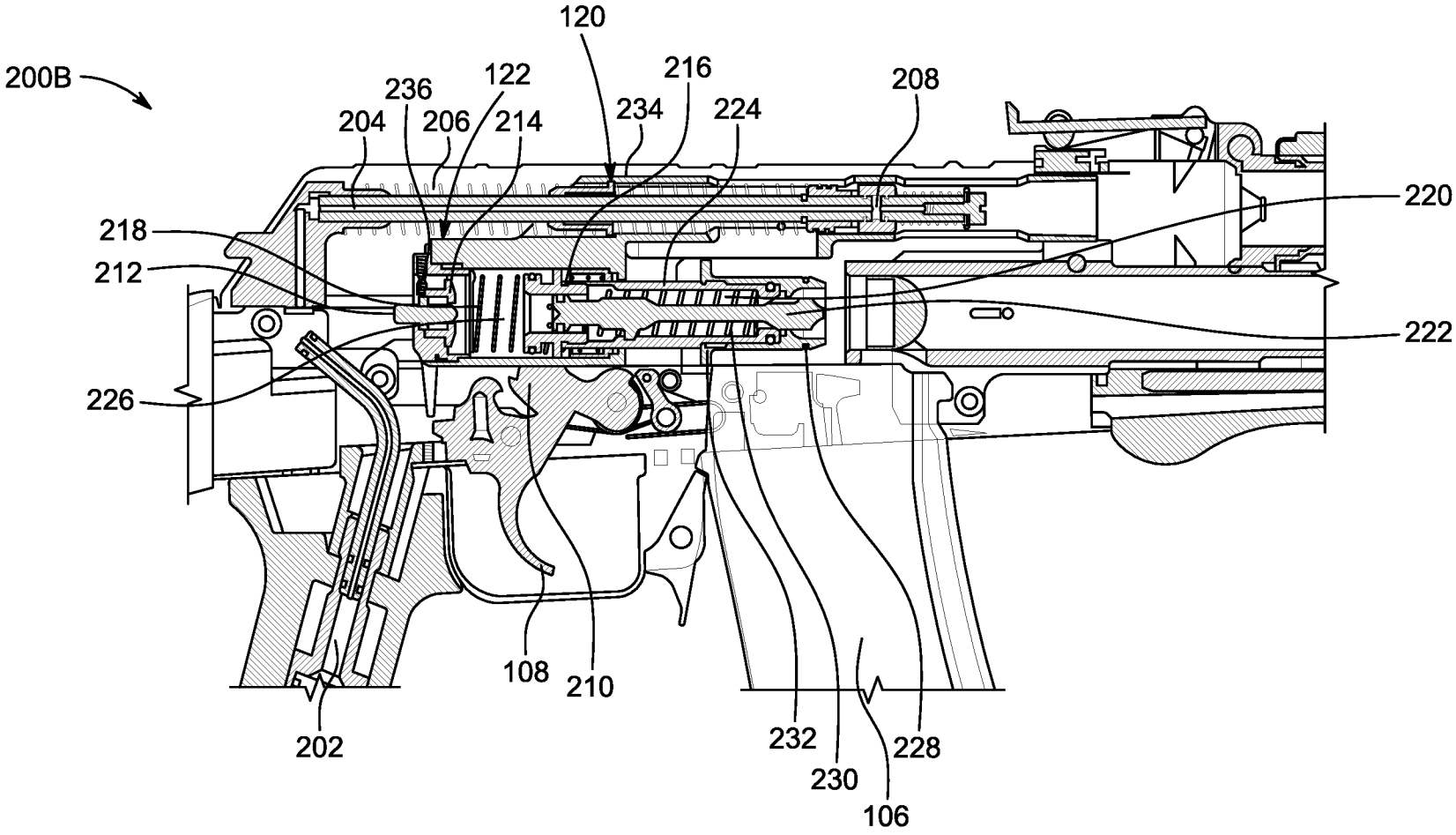
FIG. 2B illustrates a sectional view of the air gun in a complete recoiling position, according to an embodiment of the present disclosure.
Figure 2C:
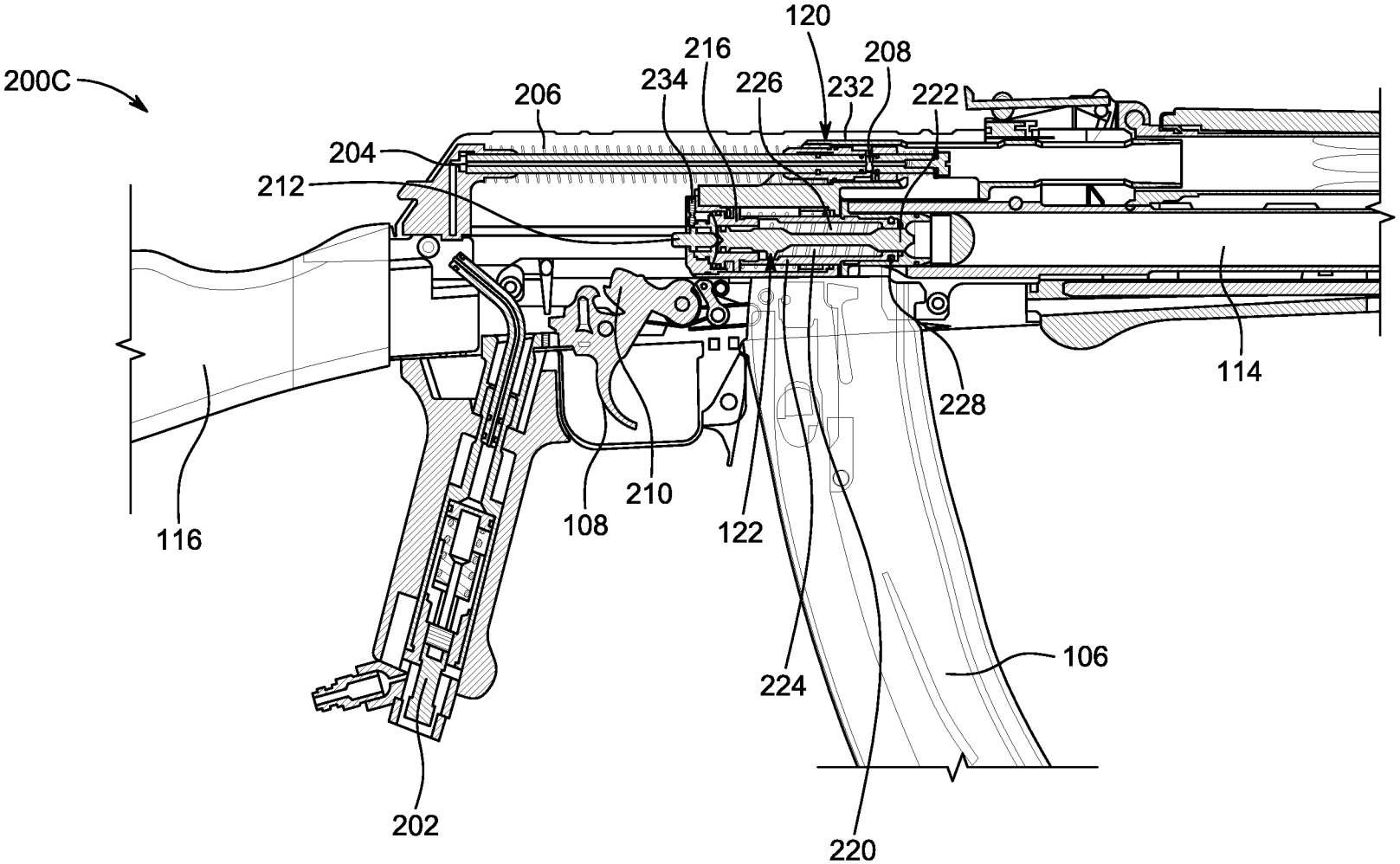
FIG. 2C illustrates a sectional view of the air gun in a rest or a ready-to-fire position, according to an embodiment of the present disclosure.

FIGS. 2A-2C illustrates sectional views of the air gun 100 according to an embodiment of the present disclosure. FIGS. 2A-2C are explained in conjunction with FIG. 1. The FIG. 2A illustrates the sectional view 200A of the air gun 100, when the air gun 100, is in a partial recoiling position. The air gun 100 may include but not limited to components or mechanisms as may be herein described. The air gun 100 may be provided with a design of components and with an intention to create an automatic air gun which may be primarily employed in the game of paintball and firing non-lethal projectiles. The air gun 100 may involve a mechanism that ejects or fires projectiles using compressed air and may also contain a majority of its critical firing mechanism within a moving unit that creates recoiling motion which may cycle and reset the action of the air gun 100.

FIGS. 2A-2C illustrate the sectional views of the air gun 100 which may include a primary set of components and a secondary set of components. In one embodiment, the primary set of components may include, but are not limited to, the bolt carrier unit 122, as discussed in FIG. 1. It can be noted that the bolt carrier unit 122 may be referred to as a bolt-valve assembly or a bolt carrier assembly. In another embodiment, the secondary set of components may include, but are not limited, to the recoil gas unit 120, as discussed in FIG. 1. It can be noted that the recoil gas unit 120 may be referred to as a recoiling assembly.

In one embodiment, the air gun 100 may comprise a regulator 202, coupled to the handle 112. The regulator 202 may also be coupled to a recoil guide tube 204, which may be positioned under the cover 104 of the air gun 100. It can be noted that the regulator 202 may supply an air charge or compressed air, which may travel upwards into the recoil guide tube 204. Further, the regulator 202 may be connected to the recoil guide tube 204, via an air channel. In one embodiment, the regulator 202 may act as a screw to clamp the handle 112 onto the air gun 100. In one exemplary embodiment, the regulator 202 may be referred to as an air flow guiding element or an air passage. In one exemplary embodiment, the recoil guide tube 204 may be a long elongated pipe used to guide the compressed air in the air gun 100, into the bolt carrier unit 122, for ejecting the projectile. Further, the recoil guide tube 204 may be configured to supply the air charge or compressed air. Further, the recoil guide tube 204 may be wrapped around with a recoil assembly spring 206, which may assist the recoil guide tube 204 during the recoiling action of the air gun 100. In one embodiment, the recoil guide tube 204 may be coupled to a shut-off valve 208 at a front end of the air gun 100, as shown in FIG. 2A. The shut-off valve 208 may be disposed along a length of the recoil guide tube 204 and configured to hinder the compressed air being delivered to bolt carrier unit 122. Further, the shut-off valve 208 may prevent the compressed air from flowing out of the recoil gas unit 120, during recoil stroke of the air gun 100. In one embodiment, the shut-off valve 208 may result in lowering of friction between the bolt carrier unit 122 and the recoil gas unit 120 when high pressures may be applied to the sealing surfaces of the bolt carrier unit 122 and the recoil gas unit 120. In one embodiment, the shut-off valve 208 may be referred as an air flow restriction device. In an embodiment, the recoil gas unit 120 may comprise a flow reduction mechanism to achieve a sufficient pressure differential to cycle the air gun 100. Further, the flow reduction mechanism may be used to hinder the compressed air being delivered to the bolt carrier unit 122. Further, the flow reduction mechanism may comprise a narrow orifice to restrict flow of compressed air.

In one embodiment, the trigger 108 may be disposed between the handle 112 and the magazine 106 of the air gun 100. It can be noted that the air gun 100 is put into action, when the trigger 108, is pulled backwards by an operator of the air gun 100. In one embodiment, the trigger 108 may be pulled backwards manually in order to actuate a hammer 210. Further, the hammer 210 may be mounted to the housing 102 over an axis pin, and a spring between the trigger 108 and hammer 210, may cause the hammer 210 to swing up and move forward with force. Further, when actuated, the hammer 210 may strike a firing pin 212 of the bolt carrier unit 122. It can be noted that the firing pin 212 may be the first component of the bolt carrier unit 122, which is triggered by the trigger 108, via the hammer 210. Further, the firing pin 212 may be disposed at a rear end or a second end of the bolt carrier unit 122. In one embodiment, the firing pin 212 may be provided with a retainer 214, disposed on an inner side of the bolt carrier unit 122. In one embodiment, the retainer 214 may be on an outer side of the bolt carrier unit 122 or on an outer side of the firing pin 212. It can be noted that the retainer 214 may allow the bolt carrier unit 122, to retain or hold the firing pin 212 in place and may prevent the firing pin 212 from falling out of the bolt carrier unit 122.

Further, the bolt carrier unit 122 may comprise a piston head 216 and a recoil piston return spring 218. In one embodiment, a first end of the recoil piston return spring 218 may be coupled to the retainer 214, and a second end of the recoil piston return spring 218 may be coupled to the piston head 216. In one embodiment, the recoil piston return spring 218 may be positioned between a forward face of the piston head 216, and an inside surface of the bolt carrier unit 122. Further, the bolt carrier unit 122 may comprise a valve chamber 220 integrated within a piston 224. Further, the recoil piston return spring 218, may act to bias the piston 224 towards rear, and ensures that a rear edge of the piston 224 may be sealed into a rear end of a piston chamber 226. Further, the piston chamber 226 may be a region integrated behind the piston head 216. In one embodiment, the piston chamber 226 may be referred as a cylinder bore. Further, at rest, the piston 224 may be at the rear end of the piston chamber 226, and the valve chamber 220 may be at a maximal volume while the piston chamber 226 may be at minimal volume. Further, during firing, as the recoil stroke starts to happens, the piston chamber 226 may be filled with a high pressure air, while the valve chamber 220 may be venting its air down the barrel 114, and therefore, a new pressure gradient created, may cause the recoil effect. Further, the recoil effect may compress the recoil piston return spring 218 and thereby may make the valve chamber 220 reduce to minimal volume while the piston chamber 226 may be at maximal volume. Lastly, due to a plurality of small sized bleed holes, the piston chamber 226 may quickly return to the atmospheric pressure, while the recoil piston return spring 218, may force a bolt 228 back to a rear of the bolt carrier unit 122, expanding the size of the valve chamber 220 again, and pushing a valve pin 222 back into position so that when air pressure is again supplied it may fill the valve chamber 220.

In one embodiment, when the piston head 216 is actuated, the valve pin 222 may be pushed forward by the firing pin 212. It can be noted that the area between the retainer 214 and the piston head 216 may be referred to as the piston chamber 226. Further, the recoil piston return spring 218 may be disposed within the piston chamber 226. The piston chamber 226 may be integrated at the second end of the bolt carrier unit 122. The second end of the bolt carrier unit 122 may be the rear end of the bolt carrier unit 122. In one embodiment, when the trigger 108 is actuated, a check valve (not shown) integrated on a side air passage of the bolt carrier unit 122 may be opened and may draw compressed air into the bolt carrier unit 122. Further, the check valve may be open while the bolt carrier unit 122 may be in a resting forward position, allowing air pressure to be normalized between the air gun 100 and bolt carrier unit 122. Further, the check valve may only close up, when the bolt carrier unit 122 moves into a position as there may be no longer compressed air upstream of the check valve, at which point the check valve may prevent the compressed air inside the bolt carrier unit 122 from venting. It can be noted that the bolt carrier unit 122 allows compressed air, from the recoil guide tube 204, to travel into the valve chamber 220. The compressed air may be expanded and may allow ejecting projectiles down the barrel 114 and out of the air gun 100. It can be noted that the check valve may also prevent a back flow of compressed air out of the bolt carrier unit 122 into the atmosphere. In one embodiment, the recoil piston return spring 218 may be a low-energy recoil piston return spring 218. Such a use of the low-energy recoil piston return spring 218 may reduce the chances of damage of the projectile by the recoil piston return spring 218. Further, the low-energy recoil piston return spring 218 may reduce to a round being loaded by the bolt into the barrel 114. In another embodiment, the recoil piston return spring 218 may be a high-energy spring, causing the bolt 228 to smash the rounds. In another embodiment, the recoil piston return spring 218 may be a combination of a low-energy spring and a high-energy spring.

In one embodiment, the piston head 216 may be coupled to the valve pin 222. It can be noted that the valve pin 222 is positioned inside the piston 224 of the bolt carrier unit 122. In an embodiment, the piston head 216 may be coupled to the piston 224 at the first end, and the valve pin 222 may be coupled with the piston head 216 at the second end of the piston 224. The piston 224 may be disposed at a first end of the bolt carrier unit 122. Further, the valve pin 222 may be also referred to as a cup seal. The valve pin 222 may be coupled with the piston head 216, at the second end of the piston 224. Further, the valve pin 222 may be wrapped around with a valve pin spring 230, as shown in FIG. 2A. In on embodiment, during the firing stroke the firing pin 212 may actuate the valve pin 222 and the valve pin spring 230 wrapped around the valve pin 222 may be compressed. The valve pin spring 230 may also be referred to as a firing pin spring. Further, after firing the projectile, the valve pin spring 230 may allow to push and then recoil or move back the valve pin 222. In an embodiment, the piston head 216 may remain fixed, and the valve pin 222, and the valve pin spring 230 may be configured to move towards the barrel 114 of the air gun 100, to release air after the firing stroke is completed. The second end of the piston 224 may be coupled with a bolt 228 (also known as bolt cap) to provide compactness to the piston 224. In one embodiment, the bolt 228 may be configured to move rearward and may be pushed against the barrel 114, when the piston chamber 226 causes a recoiling action of the bolt carrier unit 122. In one embodiment, the bolt 228 may be threaded on an inner rear side and may be provided with a bolt flange 232. In one embodiment, the function of the bolt 228 may be to chamber a round of the air gun 100. Further, the bolt flange 232 may be provided to press up against the barrel 114 and may transmit energy from the piston head 216 into the barrel 114. It can be noted that the piston head 216, the valve pin 222, the valve pin spring 230, and the piston 224, together may be herein referred to as a bolt piston or a recoil piston, or simply a piston or a valve chamber 220.

In one embodiment, the recoil guide tube 204 may be coupled with the recoil unit 120 at a recoil tube carrier 234. The recoil guide tube 204 may be attached to the recoil tube carrier 234 at a first end of the recoil guide tube 204. The first end of the recoil guide tube 204 may be a front end of the recoil guide tube 204. It can be noted the recoil tube carrier 234 may be referred to as an upper tube. The recoil tube carrier 234 may also be referred to as a recoil assembly compartment. The compressed air may pass through the recoil gas unit 120 into the valve chamber 220 via the piston head 216 of the bolt carrier unit 122. Further, the recoil piston return spring 218 may be loaded over the piston 224. In one embodiment, the piston chamber 226 may be integrated within the second end of the bolt carrier unit 122, between the cap 236 and the piston 224. Further, the valve chamber 220 may facilitate the movement of the piston 224 and may be configured to receive the compressed air for performing the firing stroke of the air gun 100.

In one embodiment, the compressed air from the recoil tube carrier 234 may travel into the piston 224. Further, the piston 224 may be provided with a plurality of holes around its circumference, which allow the valve pin 222 to fire the projectile down the barrel 114. In another embodiment an annular cup seal may be provided on the valve pin 222 and the valve pin 222 may be held rightly against a forward surface of the piston 224 and when pushed forward the annular cup seal may break allowing the compressed air to escape through a cap and around the cup seal. Further, a recoil action of the air gun 100 may cause the valve pin 222 to move forward and compress the valve pin spring 230 and allow the air which inside the piston 224, to expel out from the air gun 100. It can be noted that during the recoil stroke, the shut-off valve 208 may prevent any air to expel out of the recoil tube carrier 234. Further, the piston 224 may be coupled with the cap 236. It can be noted that the cap 236 may restrict the flow of air from the piston 224. In one embodiment, the cap 236 may comprise a plurality of bleed holes integrated on the cap 236 to vent the restricted flow of air quickly after the recoil stroke. In an embodiment, the cap 236 may be referred as a back cap or front end cap of the bolt carrier unit 122.

In an embodiment, a ball check valve 238 may be integrated on a side air passage of the bolt carrier unit 122. It can be noted that the ball check valve 238 may prevent the compressed air from venting out or flowing back out of the bolt carrier unit 122, through the recoil tube carrier 234, when the bolt carrier unit 122 is in recoiling position. It can be noted that the ball check valve 238 may be referred to as a check valve. In an embodiment, the ball check valve 238 may be configured to prevent the compressed air from venting out of the valve chamber 220 and the piston chamber 226. In an exemplary embodiment, when the bolt carrier unit 122 moves so that the recoil guide tube 204 is not engaged and sealed inside the recoil tube carrier 234, the ball check valve 238 prevents the air from venting out of the valve chamber 220. In another embodiment, the ball check valve 238 may be configured to retain the compressed air within the valve chamber 220, when the bolt carrier unit 122 may be disassembled from the air gun 100. It can be noted that the ball check valve 238 may also prevent a back flow of compressed air out of the bolt carrier unit 122 into the atmosphere.

In one embodiment, during a firing operation of the air gun 100, the trigger 108 is actuated by an operator of the air gun 100. Further, the actuation of the trigger 108 may allow the regulator 202 to expel the compressed air (also known as an air charge), from the external air supply, into the barrel 114. The expelling air forces the projectile to run down the barrel 114 and launch the projectile at a desired speed from the muzzle of the barrel 114. In another embodiment, the air gun 100 after being fired may have a recoil stroke. It can be noted that when an initial air charge, while the firing operation, is directed into the barrel 114, an amount of compressed air may be sent to the piston 224. The compressed air may result in creating a recoil force in the bolt carrier unit 122. The recoil force may move the bolt carrier unit 122, in the backward direction. Further, the recoil stroke may recharge the hammer 210. In yet another embodiment, after the recoil stroke of the air gun 100, the recoil piston return spring 218 may push bolt carrier unit 122 to the resting position, as shown in FIG. 2C. Further, a projectile may be fed, from the magazine 106, into a path of the bolt carrier unit 122, to be loaded into air gun 100. The piston 224 may include the piston head 216 which may be coupled with the valve pin 222 and the valve pin spring 230. The piston 224 may be closed with the bolt 228 on the front end of the bolt carrier unit 122. The bolt 228 may be provided with a circular flange which may move according to the motion of the bolt 228 during the recoiling and the returning stroke.

FIG. 2B illustrates the sectional view 200B of the air gun 100 in a complete recoiling position, according to an embodiment of the present disclosure. Further, the sectional view 200B illustrates the bolt carrier unit 122 in a complete recoiled position. It can be noted that during the complete recoiled position of the bolt carrier unit 122, the recoil assembly spring 206 may be pushed rearwards and may be in complete tension. The recoil assembly spring 206 may be coupled to the recoil guide tube 204 and disposed within the recoil tube carrier 234, for movement of the recoil guide tube 204. The recoil assembly spring 206 may facilitate the movement of the bolt carrier unit 122 during a recoil stroke. Further, the recoil tube carrier 234 may also move along the length of the recoil guide tube 204, and thereby the recoil assembly spring 206 may get compressed for an increased length than in standing or rest position. In one embodiment, the air gun 100 may be referred to have a closed bolt type action, which means that at rest the bolt 228 may be held closed by the bolt carrier unit 122 and the bolt carrier unit 122 may be pushed forwards by the recoil assembly spring 206. It can be noted that during the recoil stroke, the bolt carrier unit 122 may be pushed completely backwards and the recoil piston return spring 218 may be expanded and the air within the piston chamber 226 may also get expanded. Thus, resulting into holding the recoil assembly spring 206, in a compressed state and under tension. The recoil assembly spring 206 in tension, along with the use of the shut-off valve 208 hinders the supply of compressed air from the regulator 202, via the recoil guide tube 204.

In one embodiment, during the recoil, the backward movement of the bolt carrier unit 122 may cock or actuate the hammer 210. Further, due to the recoil, the gap between the rear end of the bolt carrier unit 122 and the back end of the air gun 100 may be reduced. It can be noted that under tension, the recoil assembly spring 206 may push the bolt carrier unit 122 forward for firing the next round of projectile. Further, the bolt carrier unit 122 may be configured to have a controlled motion of moving back and forth during the recoil stroke and the return stroke of the air gun 100. Further, the bolt carrier unit 122 may be configured to move along the length of the recoil guide tube 204. The bolt carrier unit 122 may return to rest or ready to fire position by the expansion or decompression of the recoil assembly spring 206. It can be noted that once the projectile is fired from the air gun 100, the air charge may be directed to the piston chamber 226, during the recoil stroke. Further, the air charge may create a recoil force in the bolt carrier unit 122 and allow the bolt carrier unit 122 to move backward. This action may also re-charge or cock the hammer 210. In one embodiment, the air gun 100 may be a referred to as a closed bolt gun, as the air gun 100 is loaded and ready to fire, before the operator pulls the trigger 108. In one embodiment, during the backward movement of the bolt carrier unit 122 or the complete recoiling action, the bolt 228 may also move rearwards, and by action of that, a new projectile is loaded into the barrel 114 in-front of the bolt 228.

FIG. 2C illustrates the sectional view 200C of the air gun 100 in a rest or a ready-to-fire position, according to an embodiment of the present disclosure. Further, the sectional view 200C illustrates a bolt carrier unit 122 at rest or in a standing position. It can be noted that the hammer 210 may be re-charged when the bolt carrier unit 122 moves rearwards. Further, the projectile may be reloaded when the bolt carrier unit 122 moves in a forward direction. In one embodiment, the shut-off valve 208 may also be referred to as a sliding valve. Further, during the forward stroke, the shut-off valve 208 may draw the air charge into the valve chamber 220. It can be noted that the recoil piston return spring 218 may be at minimal tension to hold the piston 224 rearwards and to ensure the flow of compressed air entering into the valve chamber 220. The mechanism of firing the projectile may be the same as described earlier. Further, the regulator 202 may be configured to supply a compressed air charge into the valve chamber 220 of the bolt carrier unit 122. The compressed air may be supplied via the recoil guide tube 204 and the recoil tube carrier 234. In one embodiment, the hammer 210 may be actuated by the trigger 108 in order to strike over the firing pin 212. The projectile drawn into the barrel 114 may be ejected towards a target as long as the compressed air flows out of the valve chamber 220 past the opened valve pin 222 into the bolt 228 behind the projectile. Further, on the backside of the piston 224, the compressed air may flow into that piston chamber 226 which may decompress the recoil piston return spring 218. Further, this action may actively force the remaining compressed air inside the valve chamber 220 to be forced out down the barrel 114, and as the air pressure holds the valve pin 222 in the forward position, the air may escape.

In one embodiment, the bolt carrier unit 122 of the air gun 100 may include the piston 224 and the cap 236. Further, the cap 236 may be provided with the firing pin 212 and the retainer 214, which holds the firing pin 212 intact. In one embodiment, the cap 236 may enclose a plurality of detents or locking surfaces, which provide additional support to the bolt carrier unit 122. In one embodiment, the cap 236 of the bolt carrier unit 122 may be coupled with an O-ring to seal the piston chamber 226 from the ambient atmosphere.

In an embodiment, during the return stroke of the air gun 100, the recoil assembly spring 206 may act to push the bolt carrier unit 122 forward to its resting or resetting position. During this, any number of mechanisms or magazines may be used to feed a projectile into the path of the bolt carrier unit 122 for it to be loaded into the chamber of the air gun 100. During the return stroke, the hammer 210 or striker system may be fully reset into a ready-to-fire position. In one embodiment, the hammer 210 may be activated at the end of the stroke when the system may be configured for full-automatic function. Such use of the air gun mechanism may provide a continuous operation of the air gun 100, without any manual intervention required by the operator. In one embodiment, the air gun 100 may resemble the operation of an operational firearm, such as the AK-47 gun.

FIGS. 3A-3E illustrate exemplary embodiments of the recoil gas unit 120 of the air gun 100, in conjunction with FIGS. 2A-2C, according to an embodiment of the present disclosure. The recoil gas unit 120 may further comprise a plug screw 302, a recoil base 304, an air channel 306, an extended hook 308, and an on/off shuttle valve 310. The plug screw 302 may be coupled at the first end of the recoil guide tube 204. In one embodiment, the plug screw 302 may act as a seal to prevent the flow of compressed gas flowing through the recoil guide tube 204. In another embodiment, the plug screw 302 may act as an end-wall or barrier for the compressed air flowing from the recoil guide tube 204 into the bolt carrier unit 122, which may flow directly out of the recoil guide tube 204 into the atmosphere. Further, the recoil guide tube 204 may be coupled to the recoil base 304 at the second end of the recoil guide tube 204. Further, the recoil base 304 may be coupled with the air inlet swivel 110 for receiving the compressed air. In one embodiment, the recoil base 304 may be integrated with the air channel 306 coupled at one end to the second end of the recoil guide tube 204 and at other end to the air inlet swivel 110. In one embodiment, the recoil base 304 an L-shaped solid metal piece with the air channel 306 integrated within for compressed air flow. In one embodiment, the recoil base 304 may be provided with an extended hook 308 integrated at a rear side of the recoil base 304. In one embodiment, the extended hook 308 may be configured to be coupled with the cover 104.

The recoil gas unit 120 may further comprise the on/off shuttle valve 310 coupled at the first end of the recoil guide tube 204. Further, the on/off shuttle valve 310 may be provided with a plurality of O-rings 312 to seal the recoil guide tube 204 and the on/off shuttle valve 310 with the recoil tube carrier 234. Further, the on/off shuttle valve 310 may be a sleeve fitted around the recoil guide tube 204. In one embodiment, when the on/off shuttle valve 310 may be pushed forward within the recoil tube carrier 234, the compressed air may be released. In one embodiment, the recoil tube carrier 234 may be an elongated tube with a first plurality of holes integrated at a first side of the recoil tube carrier 234. In another embodiment, the on/off shuttle valve 310 may be provided with a second plurality of holes 314. Further, during the forward movement of the on/off shuttle valve 310 inside the recoil tube carrier 234, the second plurality of holes 314 may be aligned with the first plurality of holes of the recoil tube carrier 234, in order to release the compressed air into the atmosphere. In one embodiment, the second end of the recoil guide tube 204 may be coupled to the recoil base 304 and the first end of the recoil guide tube 204 may be coupled to the recoil tube carrier 234.

Figure 3A:
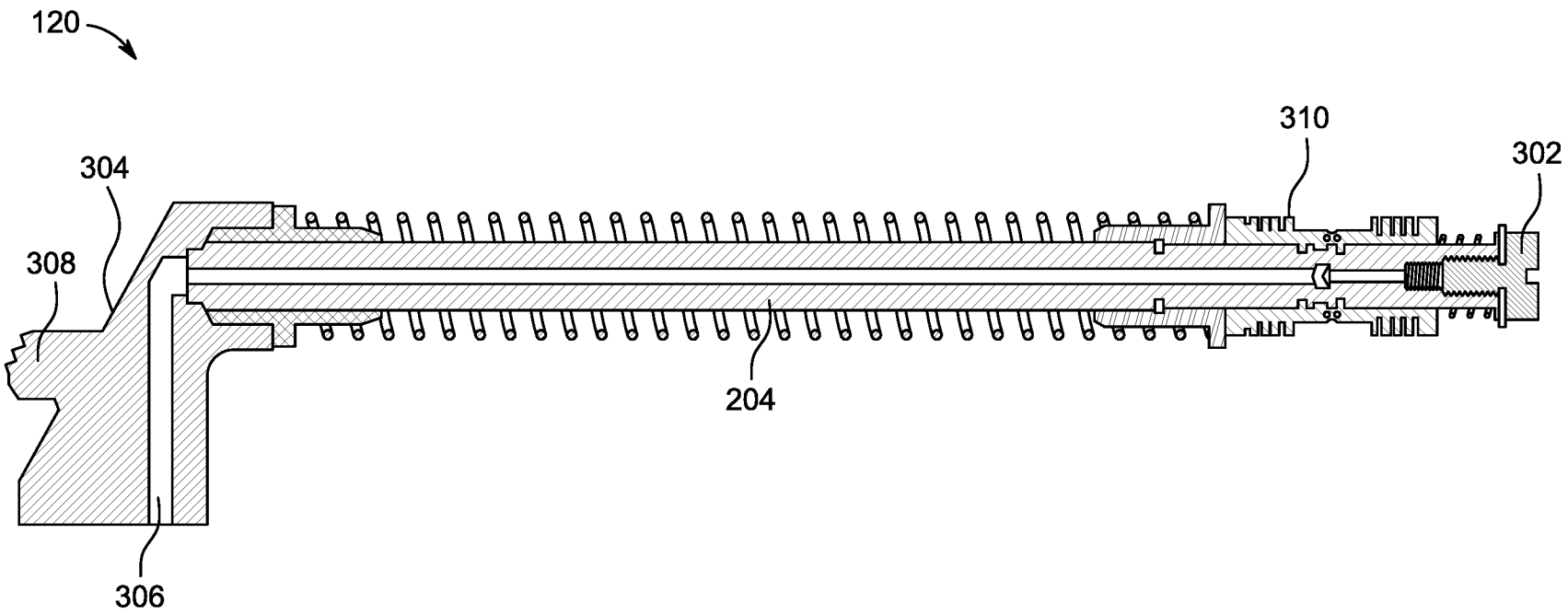
FIGS. 3A-3E illustrate exemplary embodiments of a recoil gas unit of the air gun, according to an embodiment of the present disclosure.
Figure 3B:
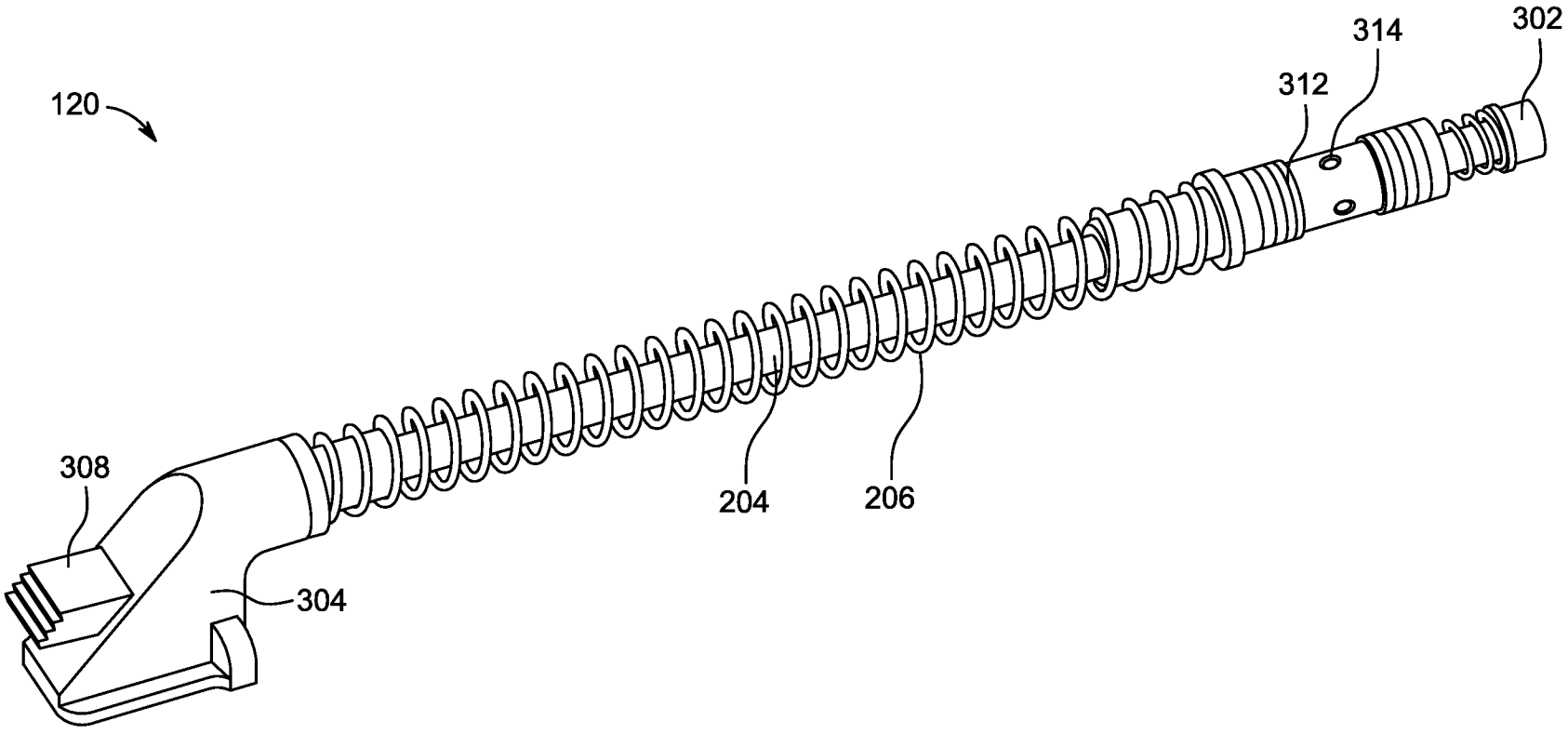
Figure 3C:
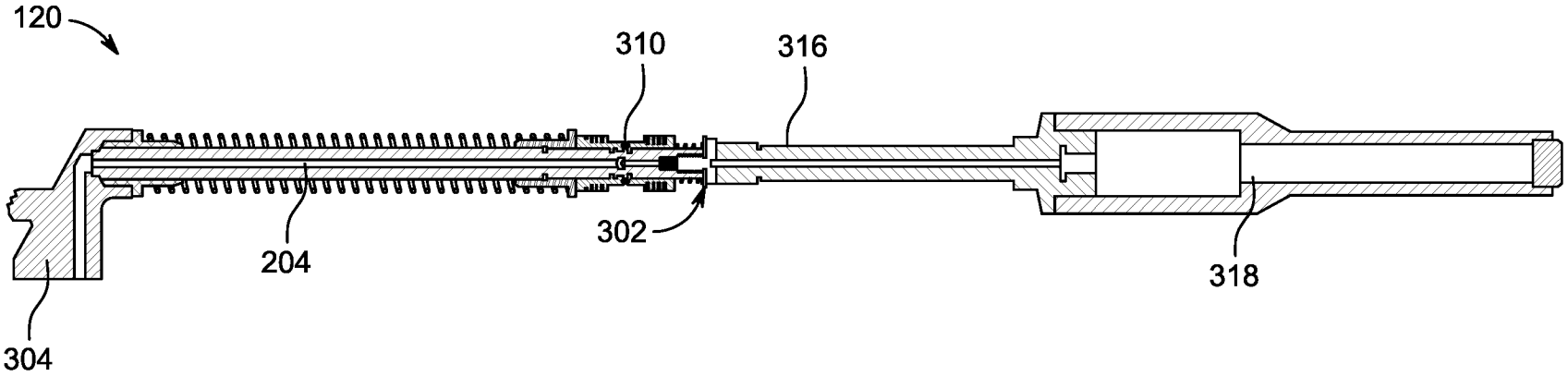
Figure 3D:
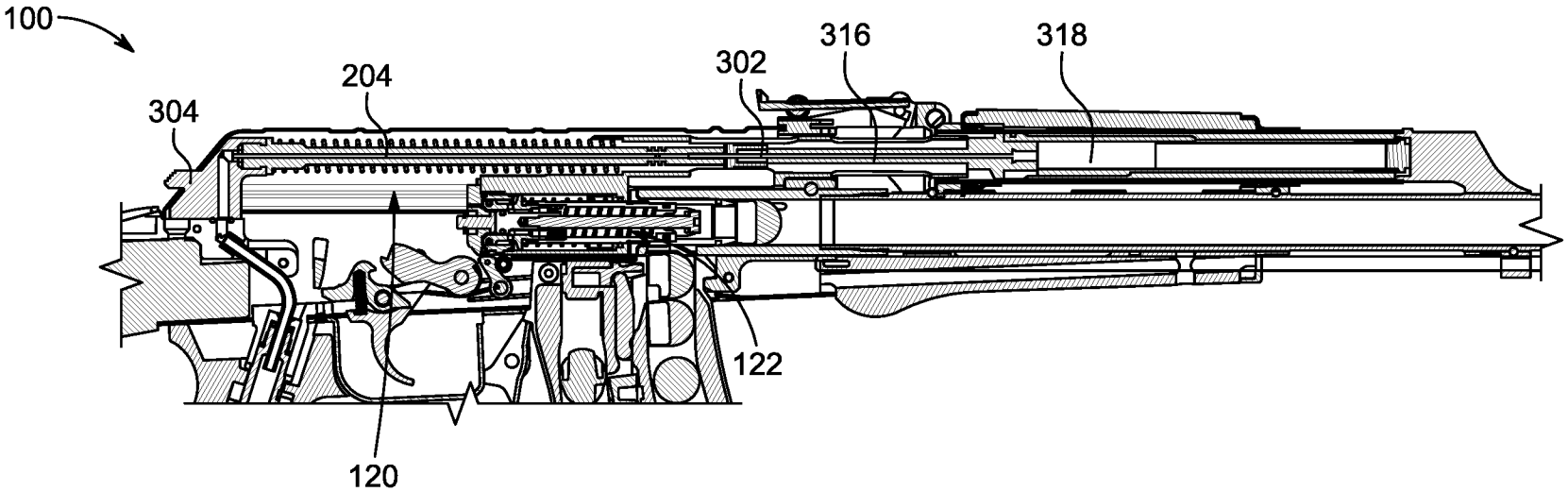

As shown in FIGS. 3C-3D, the recoil gas unit 120 may comprise an air tube 316 coupled at the first end of the recoil guide tube 204. Further, the air tube 316 may be referred as a forward air tube, which extends beyond the recoil tube carrier 234 parallel to the barrel 114 of the air gun 100. Further, the air tube 316 may be coupled with an air reservoir 318. In one embodiment, the air reservoir 318 may be referred as a forward air reservoir. Further, the air reservoir 318 may be a hollow cylinder intended to add a substantial volume of air or compressed air to the air gun 100. In one embodiment, the air reservoir 318 may be configured to store the compressed air supplied by the recoil guide tube 204, when the compressed air supply for the bolt carrier unit 122 may be shut-off during the recoiling stroke.

Figure 3E:
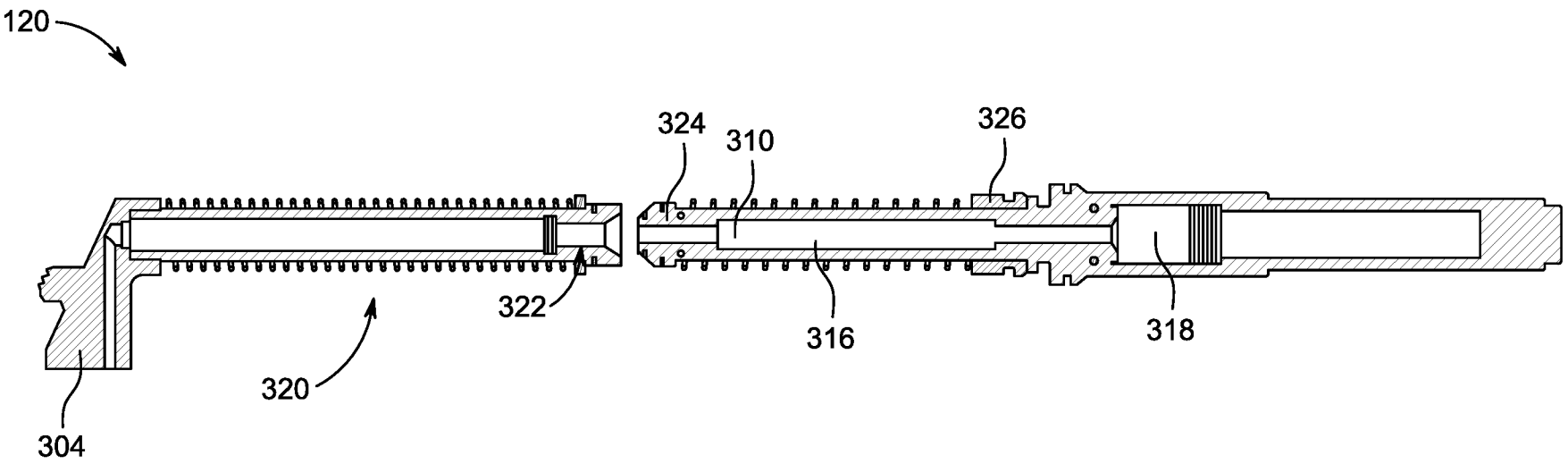

As shown in FIG. 3E, the recoil gas unit 120 may comprise a recoil guide assembly 320 coupled between the recoil base 304 and the recoil tube carrier 234. The recoil tube carrier 234 may be configured to receive the compressed air from the air inlet swivel 110 and transmit the compressed air to the bolt carrier unit 122, through the on/off shuttle valve 310. In one embodiment, a first end of the recoil guide assembly 320 may be a conical section 322. Further, the on/off shuttle valve 310 may have a tapered mating surface 324. In one embodiment, the on/off shuttle valve 310 may be coupled with the air reservoir 318 to form a single elongated unit. In one embodiment, the conical section 322 of the recoil guide assembly 320 may be coupled with the tapered mating surface 324 of the on/off shuttle valve 310. In one embodiment, the on/off shuttle valve 310 may be provided with a shuttle retainer cap 326 configured to retain the on/off shuttle valve 310 with the air reservoir 318. In one embodiment, the conical section 322 of the recoil guide assembly 320 may be disengaged from the tapered mating surface 324 of the on/off shuttle valve 310 during the firing stroke, when the firing stroke is completed. In addition, the compressed air supply to the bolt carrier unit 122 may be shut-off and the tapered mating surface 324 may engage with the conical section 322 for the flow of the compressed air towards the air reservoir 318.

Figure 4A:
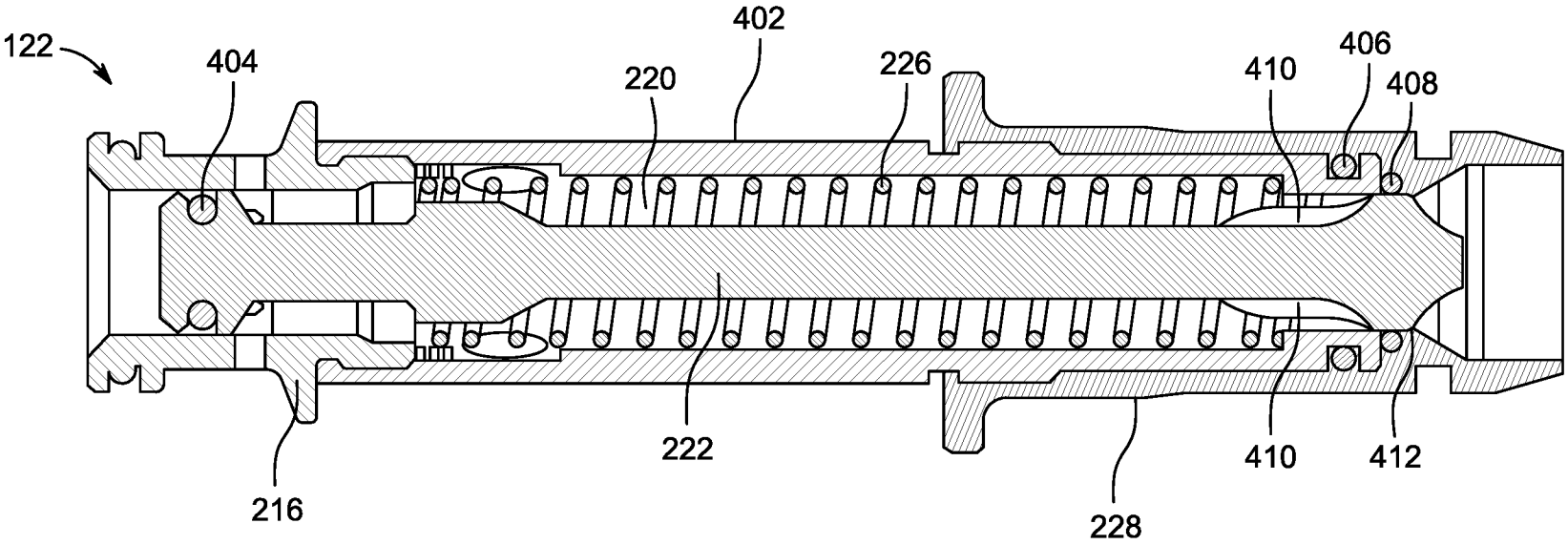
FIGS. 4A-4C illustrate exemplary embodiments of a bolt carrier unit of the air gun, according to an embodiment of the present disclosure.
Figure 4B:
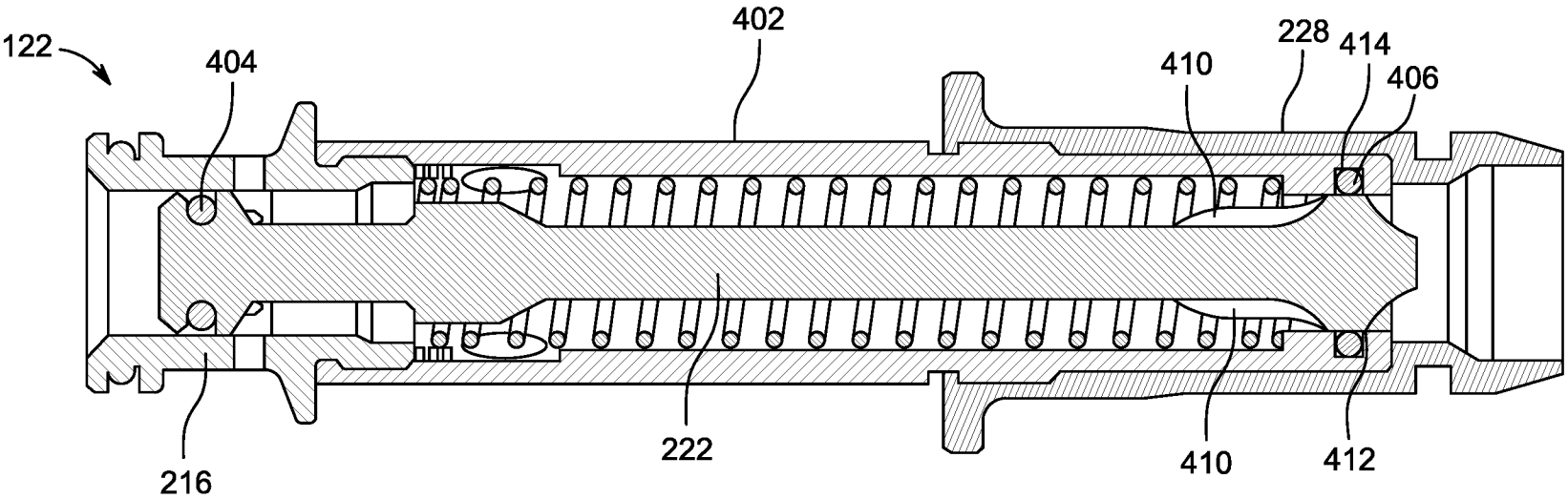
Figure 4C:
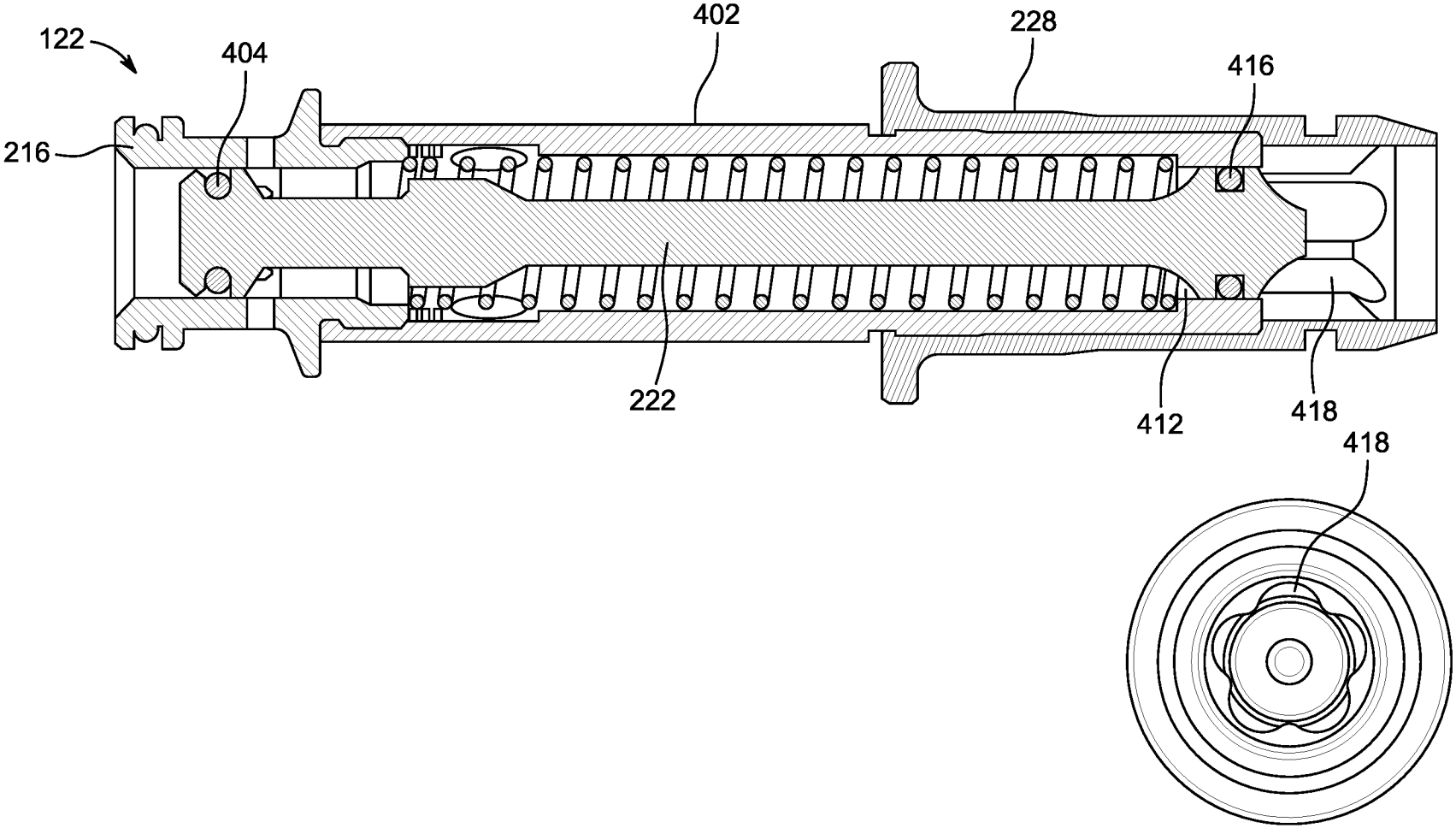

FIGS. 4A-4C illustrate exemplary embodiments of bolt carrier unit 122 of the air gun 100, in conjunction with FIGS. 2A-2C, according to an embodiment of the present disclosure. The bolt carrier unit 122 comprises the piston 224 (as shown in FIG. 4A). The piston 224 may comprise a piston body 402. In one embodiment, a first end of the piston body 402 may be coupled with the bolt 228 and a second end of the piston body 402 may be coupled with the piston head 216. Further, the piston body 402 may comprise a first pin seal 404, a second pin seal 406, and a third pin seal 408. Further, the first pin seal 404 may be integrated on the valve pin 222, at the first end of the piston 224. Further, the first pin seal 404 may be held between the piston head 216 and the valve pin 222. In one embodiment, the first pin seal 404 may act as a seal for the compressed air stored within the valve chamber 220 and prevent the compressed air from flowing out of the first end of the valve pin 222. Further, the second pin seal 406 may be integrated within the piston body 402, at the second end of the piston 224 and pressed between the piston body 402 and the bolt 228. Further, the third pin seal 408 may be held at the second end of the piston 224 and pressed by a forward face of piston 224 from a rear side of the third pin seal 408, by an inner ridge of the bolt 228 from a front side of the third pin seal 408, and by the valve pin 222 from a bottom side of the third pin seal 408. In one embodiment, the valve pin 222 may be a solid metal shaft having a first plurality of grooves 410. Further, a first end of the valve pin 222 may be coupled to the piston head 216 and a second end of the valve pin 222 having a valve pin sealing surface 412 towards the second end of the piston 224. Further, the first plurality of grooves 410 of the valve pin 222 may be integrated on the second end of the valve pin 222 and placed behind the valve pin sealing surface 412. The valve pin 222, under the effect of forward push by the firing pin 212, may move forward and the compressed air in the valve chamber 220 may travel through the first plurality of grooves 410 around the third seal pin 408.

As shown in FIG. 4B, according to an embodiment of the present disclosure, the second end of the piston 224 may be integrated with an O-ring gland 414 and the second seal pin 406 may be disposed within the O-ring gland 414, during the forward motion of the second end of the valve pin 222 to release compressed air. Further, the second pin seal 406 may be retained within the O-ring gland 414 of the piston body 402. In one embodiment, the first pin seal 404 may be referred as a rear pin seal and the third pin seal 408 may be referred as a forward pin seal. It can be noted that the forward pin seal may be retained by the bolt 228. In one embodiment, the second pin seal 406 and the third pin seal 408 may include a poppet or a spool type sealing element. The first pin seal 404, the second pin seal 406 and the third pin seal 408 are commonly referred as O-ring seals. In one embodiment, the first pin seal 404, the second pin seal 406 and the third pin seal 408 may be made from a group of materials of rubber, stainless steel, brass, alloy steel, and carbon fiber. Further, the first pin seal 404, the second pin seal 406 and the third pin seal 408 may be highly flexible O-ring seals. In one embodiment, the first pin seal 404, the second pin seal 406 and the third pin seal 408 may correspond to a dynamic O-ring to withstand dynamic shear and loads when in use. It can be noted that the first pin seal 404, the second pin seal 406 and the third pin seal 408 may create a better, more leak-proof seal for the bolt 228 and the piston body 402, with the aim usually being to prevent the unwanted escape of gases.

In one embodiment, the first plurality of grooves 410 of the valve pin 222 may be referred as vent grooves. Further, the first plurality of grooves 410 may be used for venting the compressed air stored within valve chamber 220 towards the projectile via the bolt 228. Further, the first plurality of grooves 410 may also prevent the extrusion of second pin seal 406.

As shown in FIG. 4C, according to an embodiment of the present disclosure, the valve pin 222 may be provided with a forward pin seal O-ring 416 integrated on the second end of the valve pin 222 at the second end of the piston 224. In one embodiment, the O-ring 416 may be a soft plastic cup working as a face seal or a radial seal. Further, the forward pin seal O-ring 416 may be held between the valve pin 222 and the piston body 402. In one embodiment, the forward pin seal O-ring 416 may be pressed against the piston body 402 and the bolt 228. In one embodiment, the piston body 402 may be provided with a sealing surface to act as a precision bore. In one embodiment, the bolt 228 may be provided with a second plurality of grooves 418 for retaining the forward pin seal O-ring 416 within the integrated section of the second end of valve pin 222. Further, due to the movement of the valve pin 222 to release the compressed air, which may be at high pressure, the second plurality of grooves 418 integrated on the bolt 228 may prevent the forward O-ring pin seal 416 from blowing free off the valve pin 222. In one embodiment, the second plurality of grooves 418 may also be referred as ridges integrated on an inner surface of the bolt 228. In one embodiment, the second plurality of grooves 418 may be referred as vent grooves. Further, the second plurality of grooves 418 may be used for venting the compressed air during the forward movement of the valve pin 222, and may prevent extrusion of forward O-ring seal 416.

Figure 5A:
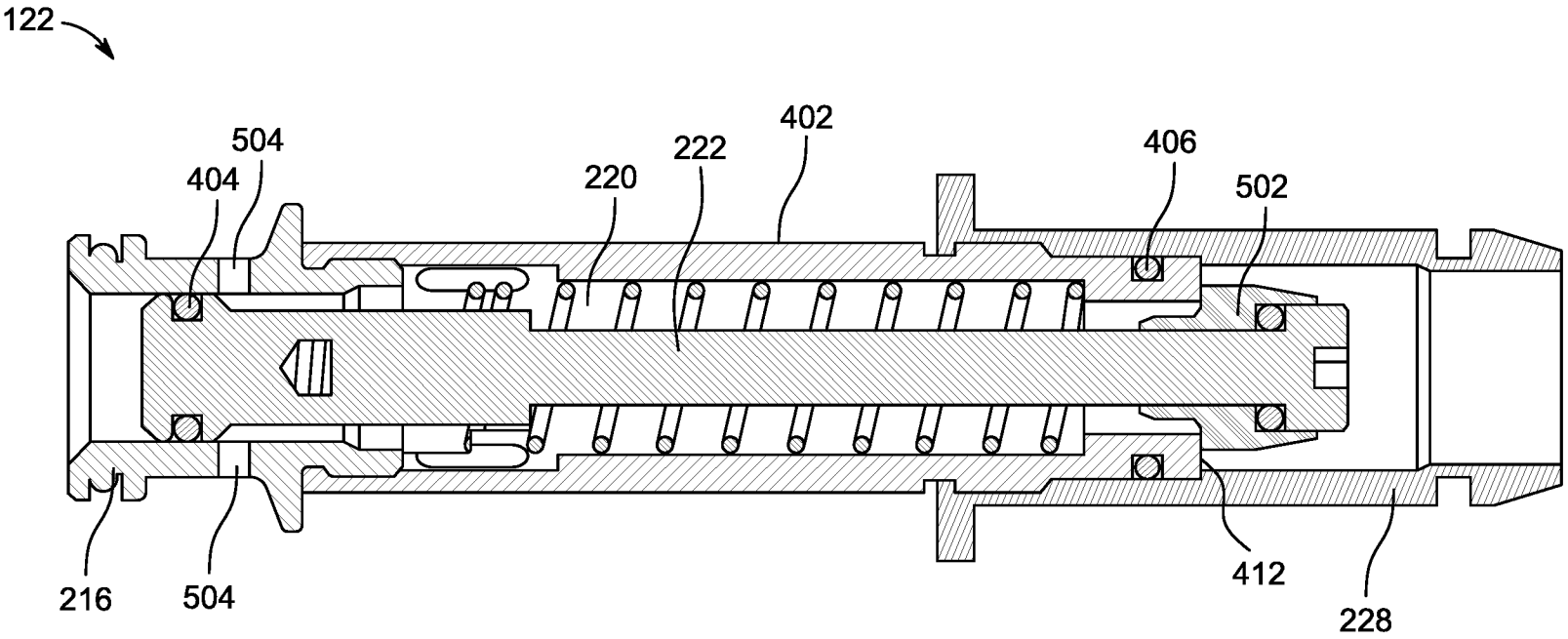
FIGS. 5A-5B illustrate another exemplary embodiment of the bolt carrier unit of the air gun, according to one preferred embodiment of the present disclosure.
Figure 5B:
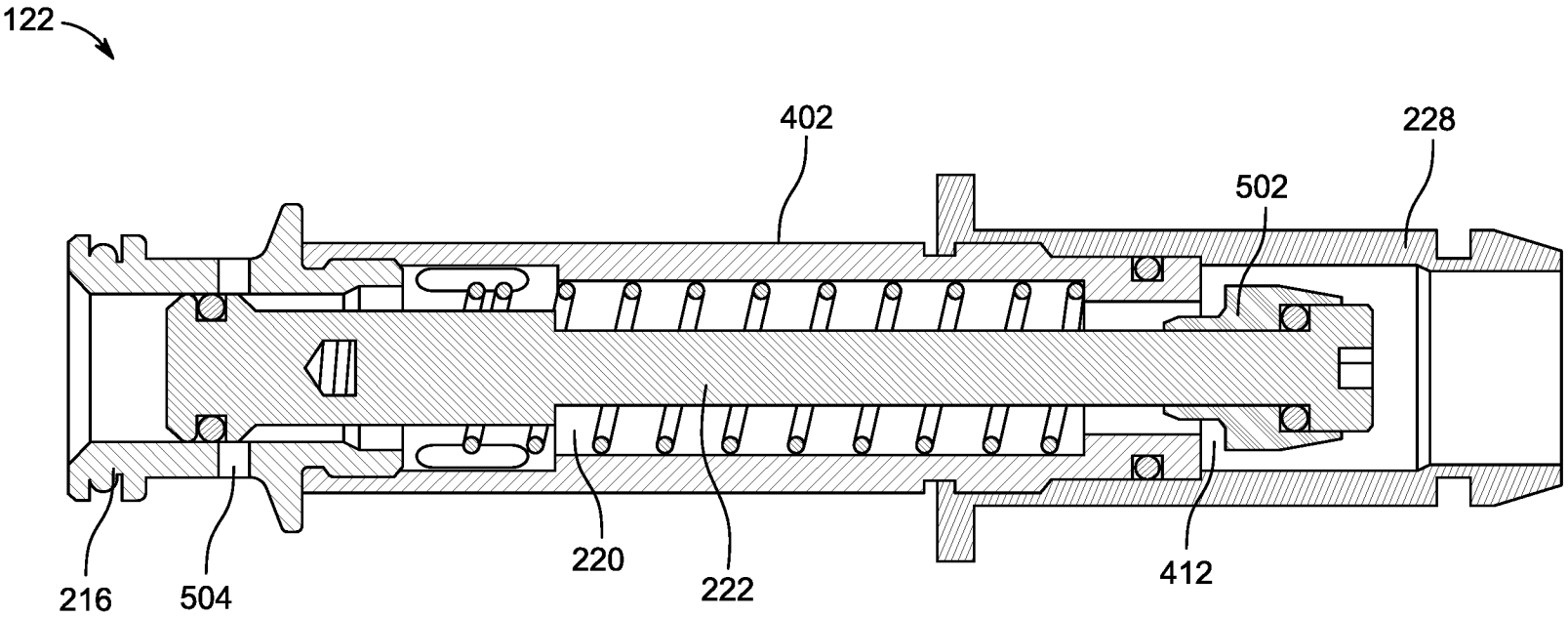

FIGS. 5A-5B illustrate another exemplary embodiment of the bolt carrier unit 122 of the air gun 100, according to one preferred embodiment of the present disclosure. The bolt carrier unit 122 comprises the valve pin 222. Further, the valve pin 222 may comprise a cup seal 502 disposed over the second end of the valve pin 222, towards the second end of the piston 224 (as shown in FIG. 5A). Further, the cup seal 502 may act as a forward seal to prevent the compressed air stored within the valve chamber 220, from flowing out into the bolt 228 without the movement of the valve pin 222. In one embodiment, the cup seal 502 may be affixed to the second end of the valve pin 222 and may be held against the second end of the piston 224 to create a seal. Further, as shown in FIG. 5B, the valve pin 222 may travel a short distance forward, before completely opening for venting the compressed air, to provide an early acceleration of the projectile. In one embodiment, the cup seal 502 may be referred as a solid cup seal. In one embodiment, the cup seal 502 and the valve pin 222 may be forged as separate units. In another embodiment, the cup seal 502 and the valve pin 222 may be forged as a single unit, such that the cup seal 502 may be over-molded permanently onto the valve pin 222.

As shown in FIGS. 5A-5B, the piston head 216 may comprise a plurality of incoming air passages 504 integrated around the circumference of the piston head 216. Further, a first incoming air passage of the plurality of incoming air passages 504 may be integrated on the piston head 216 in front of the first pin seal 404 integrated on the valve pin 222. In one exemplary embodiment, the first incoming air passage may be located on an upper side of circumference of the piston head 216. In one embodiment, the first incoming air passage may be configured to receive compressed air from the recoil gas unit 120 past the ball check valve 238, such that the received compressed air flows into the valve chamber 220 during the firing stroke. Further, when the firing pin 212 pushes the first end of the valve pin 222 within the piston head 216, the valve pin 222 moves forward to break the seal of the cup seal 502, and release high pressure compressed air towards the projectile. At the same time, the first end of the valve pin 222 may move past the first incoming air passage and the air being supplied at the moment, may get flown towards a second incoming air passage of the plurality of incoming air passages 504. In one exemplary embodiment, the second incoming air passage may be located on a lower side of circumference of the piston head 216. Further, the second incoming air passage may deliver the received compressed air to the piston chamber 226 for recoiling action of the bolt carrier unit 122. In one embodiment, the piston chamber 226 may be space integrated between the piston head 216 and the cap 236.

In one embodiment, the plurality of incoming air passages 504 may have different diameters according to a size of the piston head 216. In one exemplary embodiment, the diameter of the plurality of incoming air passages 504 may be in a range of between 0.2 millimeters (mm) to 0.8 mm. It can be noted that the first incoming air passage and the second incoming air passage may be integrated to maximize volume and strength of the valve chamber 220 during and after the firing stroke. In one embodiment, the plurality of air passages 504 inside the piston head 216 and the valve chamber 220 may reduce application of conventional tools during assembling and disassembling of the air gun 100.

FIG. 6A-6D illustrate a firing sequence operation of the air gun 100, in conjunction with FIG. 1, FIGS. 2A-2C, FIGS. 3A-3E, FIGS. 4A-4C, and FIGS. 5A-5C, according to an embodiment of the present disclosure. At first, the air gun 100 may be configured to receive the compressed air supply from the inlet air swivel 202, integrated within the handle 112 (as shown in FIG. 2A). Further, the compressed air may flow from the handle 112 into the air channel 306 of the recoil base 304. The compressed air may then flow from the air channel 306 into the recoil guide tube 204 of the recoil guide assembly 320. Further, the conical section 322 of the recoil guide assembly 320 may be disengaged with the tapered mating surface 324, and cause the compressed air flowing through the recoil guide tube 204 of the recoil guide assembly 320 flows into the valve chamber 220 of the bolt carrier unit 122, past the ball check valve 238. In one embodiment, the connection of the conical section 322 and the tapered mating surface 324, may be referred as a shuttle, which may be engaged and disengaged during the firing stroke and the recoil stroke of the air gun 100. In one embodiment, when the conical section 322 and the tapered mating surface 324 may be disengaged, and the compressed air flowing into the recoil guide tube 204 may not have an inherent directionality. Further, the disengagement of the conical section 322 and the tapered mating surface 324, the air reservoir 318 may be at full pressure and as a result of the pressure, the air reservoir 318 may be pushed forward away from the conical section 322 of the recoil guide assembly 320.

Figure 6A:
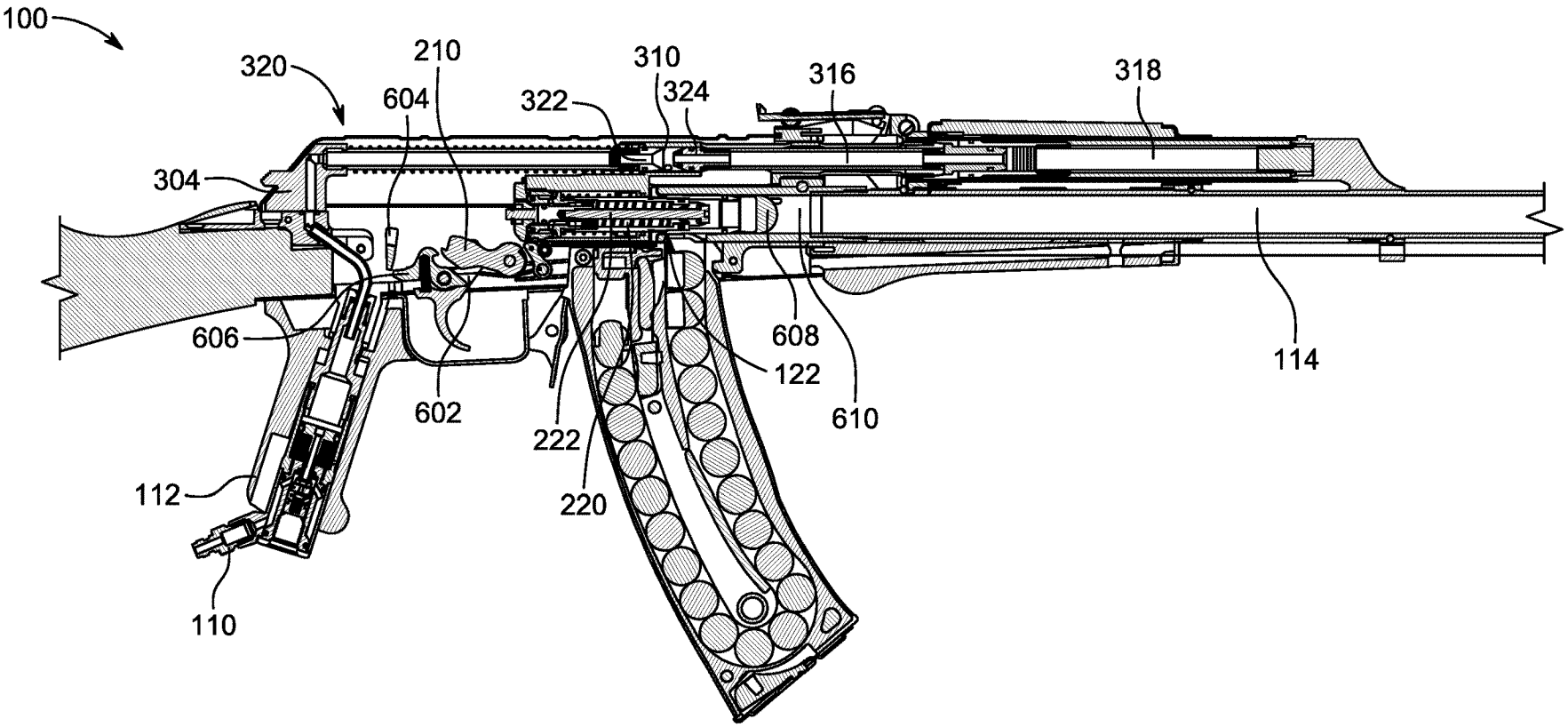
FIGS. 6A-6D illustrate a firing sequence operation of the air gun, according to one preferred embodiment of the present disclosure.

As shown in FIG. 6A, the air gun 100 is in ready to fire state and may be loaded with the bolt carrier unit 122 in forward position, at this moment the compressed air may be supplied continuously to the valve chamber 220 of the bolt carrier unit 122. Further, the hammer 210 may be cocked and the hammer 210 may be retained by a hook 602 of the trigger 108. In one embodiment, the safety selector 604 may be set in an automatic position (as shown in FIG. 6A). During the forward position of the bolt carrier unit 122, the valve chamber 220 may be fully pressurized in a ready to fire position. Further, during the ready to fire position of the air gun 100, the projectile may be loaded into the chamber of the barrel 114. In one embodiment, the projectile may be retained by a rubber dent, which may be integrated on a side wall of the barrel 114.

Figure 6B:
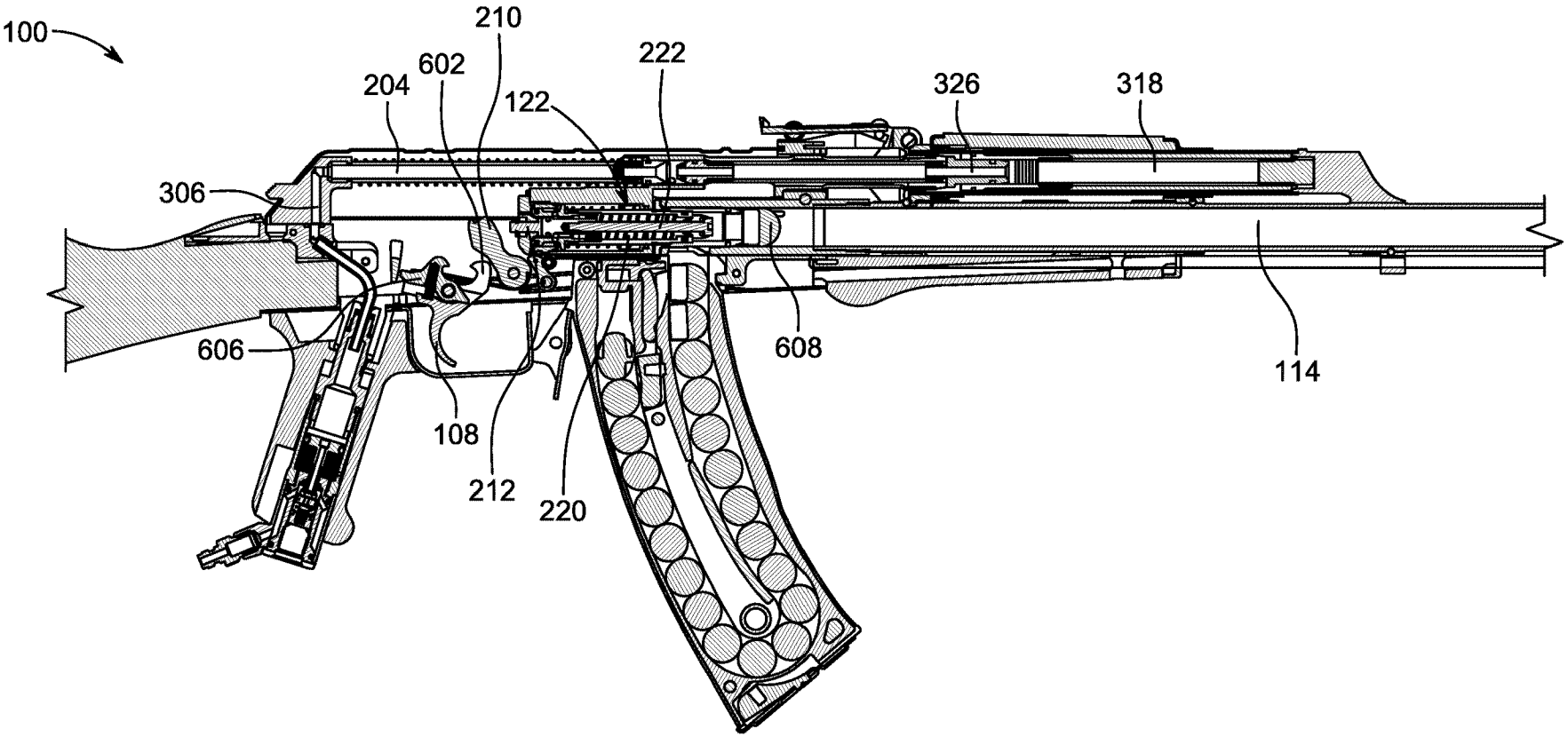

As shown in FIG. 6B, the air gun 100 may be in a first stage of firing. Herein, the trigger 108 may be pulled by the user and the hammer 210 may be actuated. In one embodiment, the hammer 210 may be lifted upwards from a disconnector 606. In one embodiment, the disconnector 606 may be pivoted on an axis parallel to an axis of the hammer 210. Further, the disconnector 606 may be configured to retain the hammer 210 during the recoil stroke of the air gun 100. Further, the hammer 210 may be pivoted forward and the hook 602 of the trigger 108 may release the hammer 210. In one embodiment, the hammer 210 may be provided with a hammer spring (not shown) which may be configured to swing the hammer 210 up and forwards, when the hammer 210 may be released from the hook 602. Further, the hammer spring may be under tension to lift the hammer 210 upwards and then rapidly forwards towards the firing pin 212 of the bolt carrier unit 122.

Figure 6C:
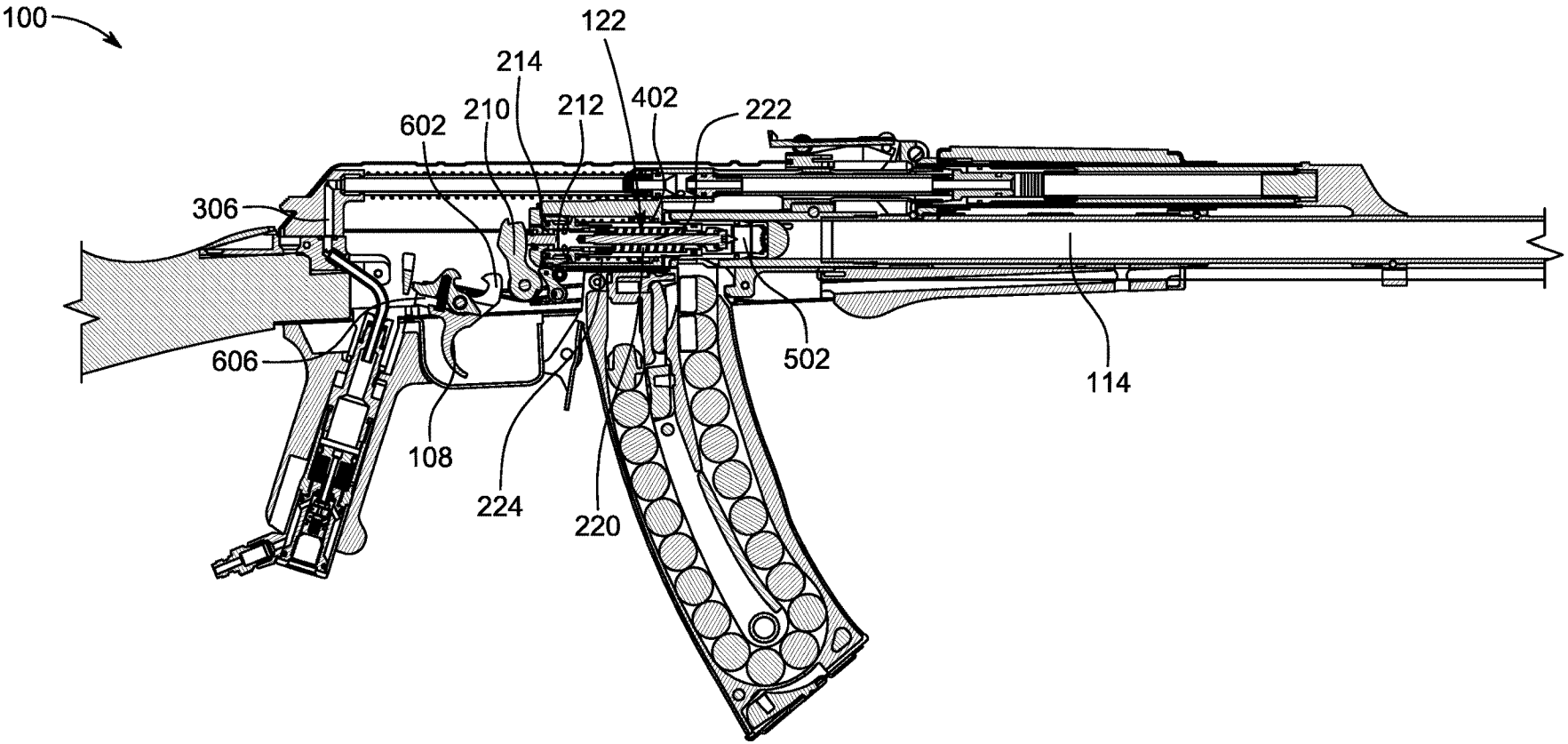

As shown in FIG. 6C, the air gun 100 may be in a second stage of firing. In one embodiment, after being swung forward by the hammer spring, the hammer 210 may strike the firing pin 212 with a force. Further, the firing pin 212 may be configured to push the first end of the valve pin 222. In one embodiment, the firing pin 212 may be provided with the retainer 214 coupled to the cap 236 of the bolt carrier unit 122, to retain or hold the firing pin 212 within the cap 236 after striking on the first end of the valve pin 222. After, the strike of the firing pin 212, the valve pin 222 under an impact of the force, may move forward towards the second end of the piston 224. Further, the second end of the valve pin 222 may crack the seal created between the cup seal 502 and the second end of the piston body 402. Further, the compressed air stored within the valve chamber 220 may be at high pressure, and the seal break may allow the compressed air to flow or vent out into the bolt 228, behind the projectile. In one exemplary embodiment, after the second end of the valve pin 222 moves beyond the piston body 402 by breaking the seal, the compressed air stored within the valve chamber 220 may begin to vent out of the valve chamber 220 through the first plurality of grooves 410. In another exemplary embodiment, the compressed air within the valve chamber 220 may vent out through the second plurality of grooves 418. Further, the compressed air at high pressure may fill up the bolt 228, which may be projected behind the projectile, to eject the projectile down the barrel 114 towards the target. In one embodiment, the compressed air may build up a charge, behind the projectile, to fire the projectile down the barrel 114.

Figure 6D:
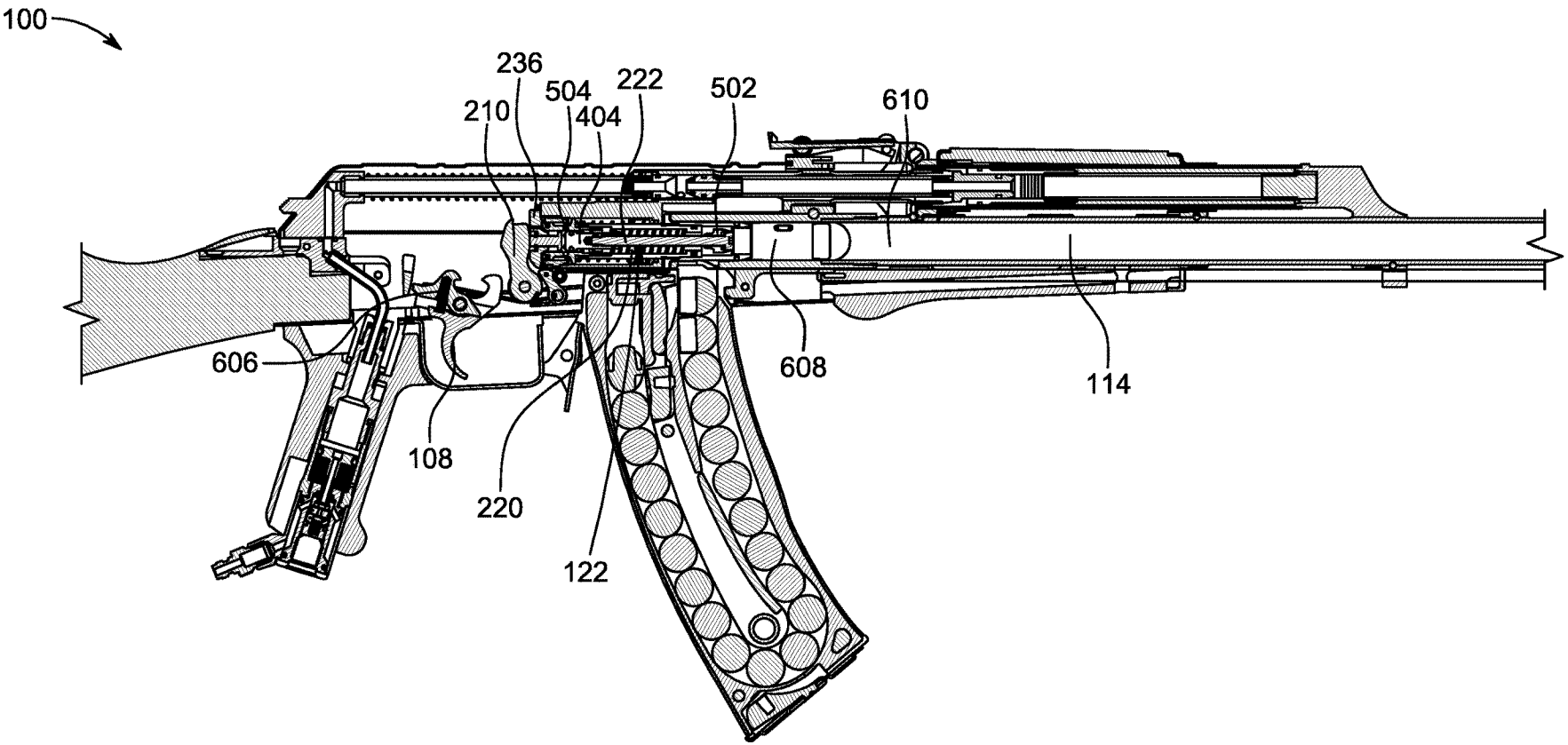

As shown in FIG. 6D, the air gun 100 may be in a third stage of the firing. After, striking the firing pin 212, both the hammer 210 and the firing pin 212 may fully stop. Further, the valve pin 222 may move further forward after the seal is broken, to allow maximum flow of air to the barrel 114, or behind the projectile. Further, the first end of the valve pin 222 may move past the plurality of incoming air passages 504 integrated on the piston head 216. Further, during the movement of valve pin 222 forwards, the first pin seal 404 integrated on the first end of the valve pin 222 may move past the plurality of incoming air passages 504. In one embodiment, the plurality of incoming air passages 504 may begin to fill in the compressed air around the firing pin within the bolt carrier unit 122. Further, the plurality of incoming air passages 504 may be configured to allow the compressed, air supplied from the recoil gas unit 120 via the ball check valve 238, to fill in a space between the cap 236 of the bolt carrier unit 122 and the first end of valve pin 222.

In one embodiment, the plurality of incoming air passages 504 may be referred as vent holes. In another embodiment, the plurality of incoming air passages 504 may be referred as radial holes of the piston head 216, configured to supply incoming compressed air flow towards the valve chamber 220 and the piston chamber 226. In one embodiment, the high pressure compressed air of the valve chamber 220, which may be stored between the piston body 402 and a forward wall of the bolt carrier unit 122, may resist the bolt carrier unit 122, from moving during an initial stage of firing. In one embodiment, the high pressure air releasing from the valve chamber 220 may begin to accelerate the projectile which may move past to a rubber dent 608 of the barrel 114 and may engage with a plurality of barrel bores 610 of the barrel 114.

Figure 7A:
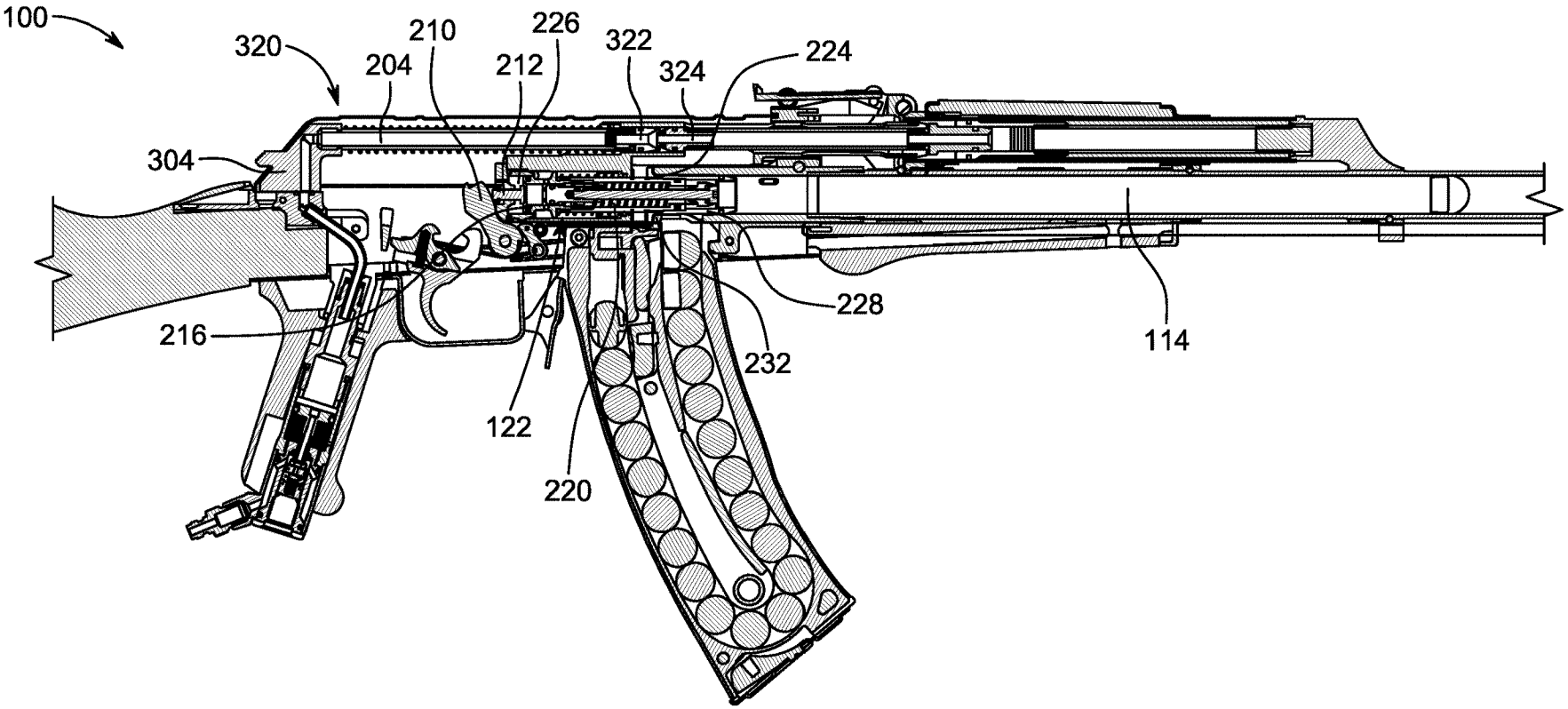
FIGS. 7A-7B illustrate a first stage of recoiling action sequence of the air gun, according to an embodiment of the present disclosure.
Figure 7B:
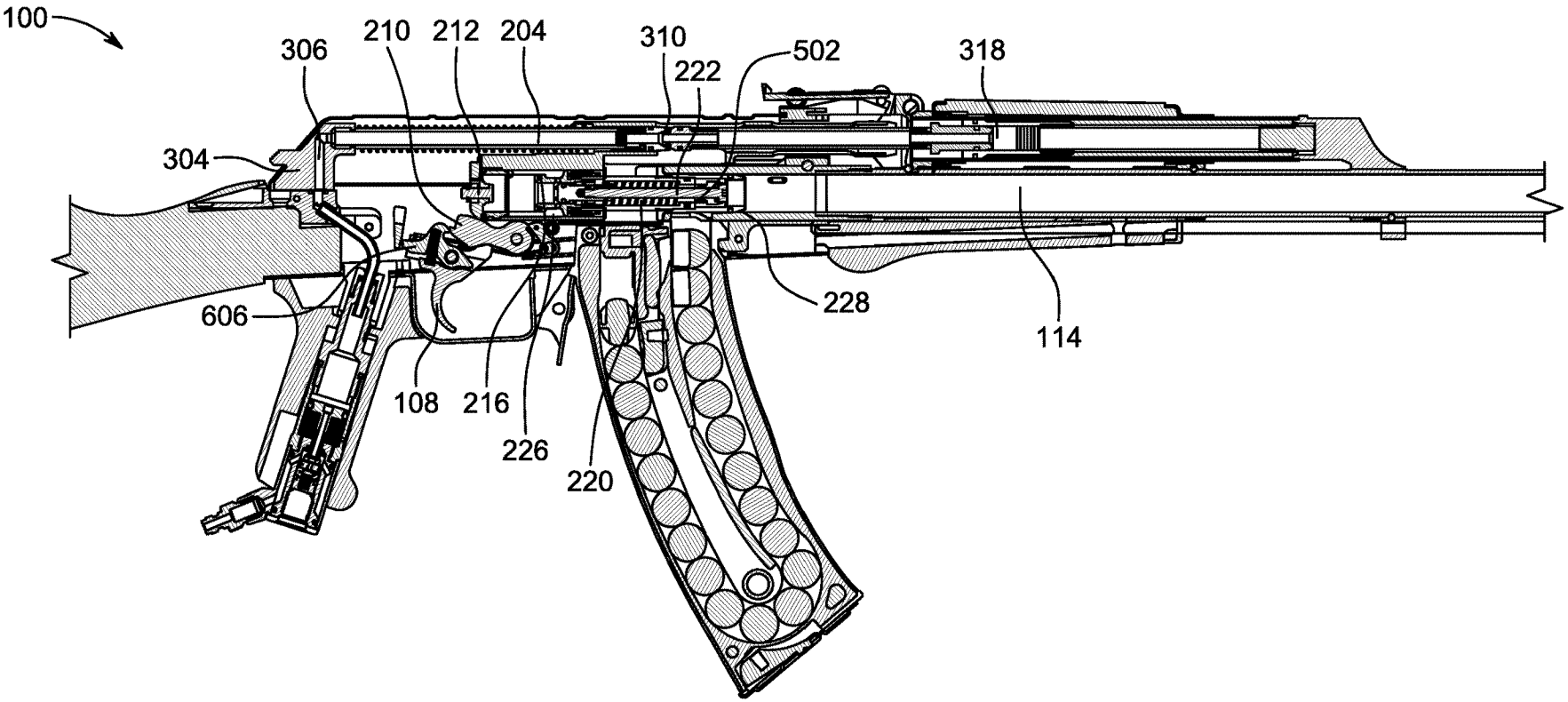

FIG. 7A-7B illustrate a first stage of recoiling action sequence of the air gun 100, in conjunction with FIG. 1, FIGS. 2A-2C, FIGS. 3A-3E, FIGS. 4A-4C, FIGS. 5A-5C, and FIGS. 6A-6D, according to an embodiment of the present disclosure. The recoiling action of the air gun 100 may be categorized in two stages, a first stage may be referred as a recoil power stroke as shown in FIGS. 7A-7B, and a second stage may be referred as a recoil coast stroke which may be shown in FIGS. 8A-8B. Further, the recoil power stroke may be performed in two steps, as illustrated in 7A and 7B.

As shown in FIG. 7A, during the recoil power stroke, the projectile may accelerate down the barrel 114 due to the high pressure compressed air venting out of the valve chamber 220. At this moment, the plurality of incoming air passages 504 of the piston head 216 may rapidly supply the compressed air into the piston chamber 226. The compressed air may push the firing pin 212 or the cap 234 rearwards, and which may consequently force the whole bolt carrier unit 122 to move rearwards. Further, the movement of the firing pin 212 rearwards, the hammer 210, which may be in a stop position with the firing pin 212, may be pushed rearwards. Further, the movement of the bolt carrier unit 122 towards the recoil base 304 may also disengage the conical section 322 and the tapered mating surface 324 of the recoil guide assembly 320. Consequently, the air pressure inside the valve chamber 220 may being to drop as the projectile moves down the barrel 114. Therefore, the reduction of air pressure inside the valve chamber 220, may reduce a force holding the second end of the piston 224. Further, the hammer 210 may be pushed by the rearward movement of the bolt carrier unit 122, and therefore swinging the hammer 210 away from the firing pin 212. In one embodiment, the piston chamber 226 may begin to receive the compressed air from the plurality of incoming air passages 504 of the piston head 216, and by the effect of which, may move the bolt carrier unit 122 rearwards, against the piston 224, which may be held in place by the bolt 228. In one embodiment, the bolt flange 232 may press firmly against the barrel 114 and thereby may prevent the bolt 228 and the piston 224 from moving forwards.

As shown in FIG. 7B, during the recoil power stroke, the air gun 100 may be in a second step of the recoil power stroke. The valve chamber 220 may vent or release out remaining air when the projectile leaves the barrel 114. The bolt carrier unit 122 may be forced to move further rearwards towards the recoil base 304, and consequently, the recoil guide assembly 320 may be opening or disengaging the conical section 322 from the tapered mating surface 324. This disengagement may fully stop or seal off the compressed air supply and the recoil piston return spring 218 may be fully compressed. Further, the hammer 210 may start to press against the disconnector 606. In one embodiment, the hammer 210 may be nearly cocked or recharged back, and a rear catch of the hammer 210 may start interfacing with the disconnector 606, which may rotate against the hammer spring. In one embodiment, the firing pin 212 may be further pushed rearwards of the bolt carrier unit 122. During this movement of the bolt carrier unit 122, the air pressure inside the piston chamber 226 may reach to a maximum point, and the bolt carrier unit 122 may be accelerated at a maximum rearward velocity towards the recoil base 304.

As shown in FIG. 7B, during the recoil power stroke, the on/off shuttle valve 310 may start pressing against the recoil guide tube 204 of the recoil guide assembly 320. In one embodiment, the on/off shuttle valve 310 may seal the recoil guide tube 204 from supplying compressed air, as the bolt carrier unit 122 may be no longer sealed to the on/off shuttle valve 310. In one embodiment, when the on/off shuttle valve 310 seals, a pressure disparity is created in the air tube 316. Further, the pressure of the air tube 316 and the air reservoir 318, may be pushed back on the on/off shuttle valve 310 and is more than the pressure from the recoil guide tube 204. Therefore, this pressure difference may be configured to maintain a greater seal. In one embodiment, when the projectile leaves the barrel 114, and the valve chamber 220 may vent out all the remaining air, the air pressure inside the valve chamber 220 drops quickly to ambient.

Figure 8A:
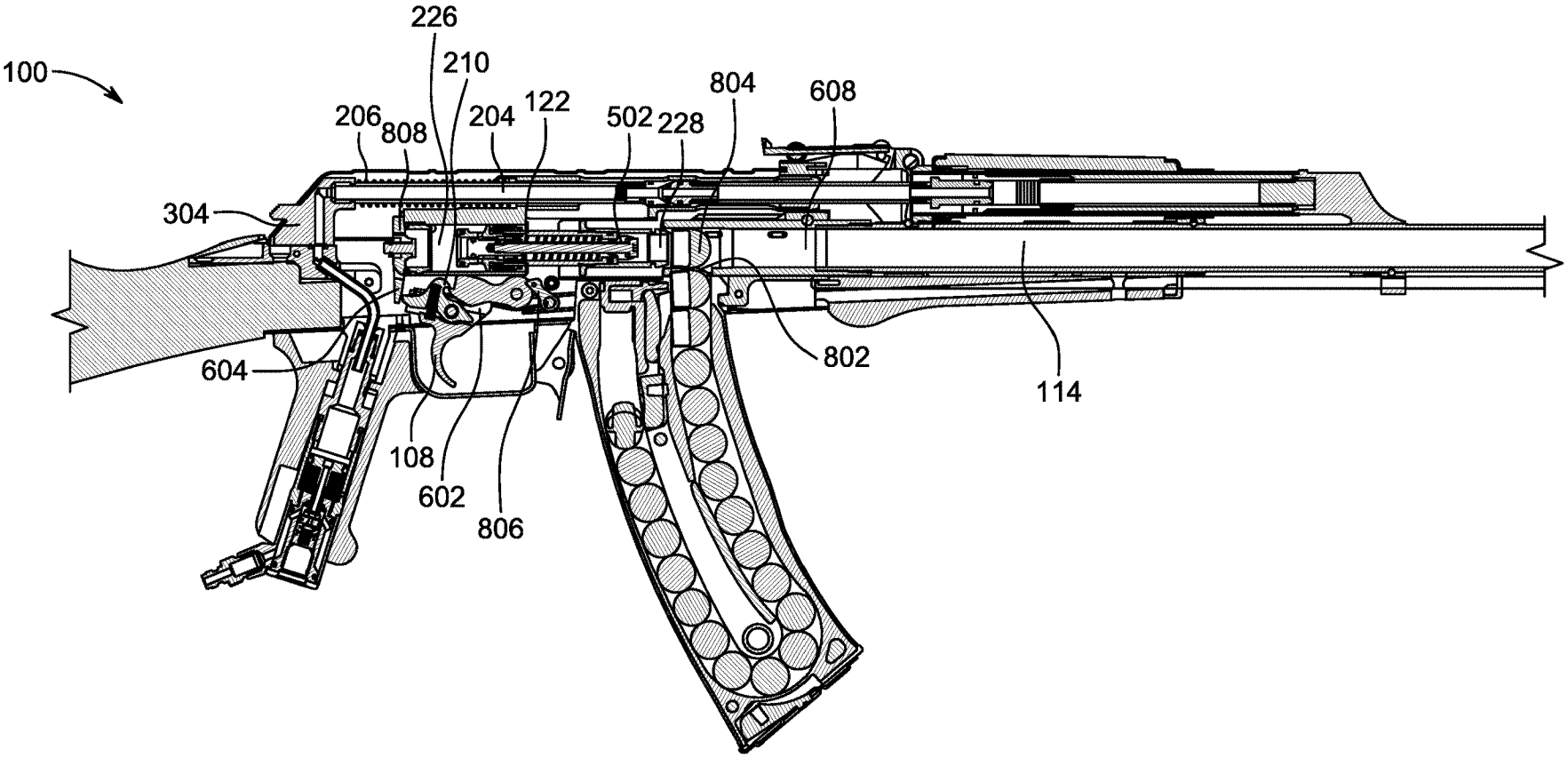
FIGS. 8A-8B illustrate a second stage of the recoiling action sequence of the air gun, in conjunction with FIGS. 7A-7B, according to an embodiment of the present disclosure.
Figure 8B:
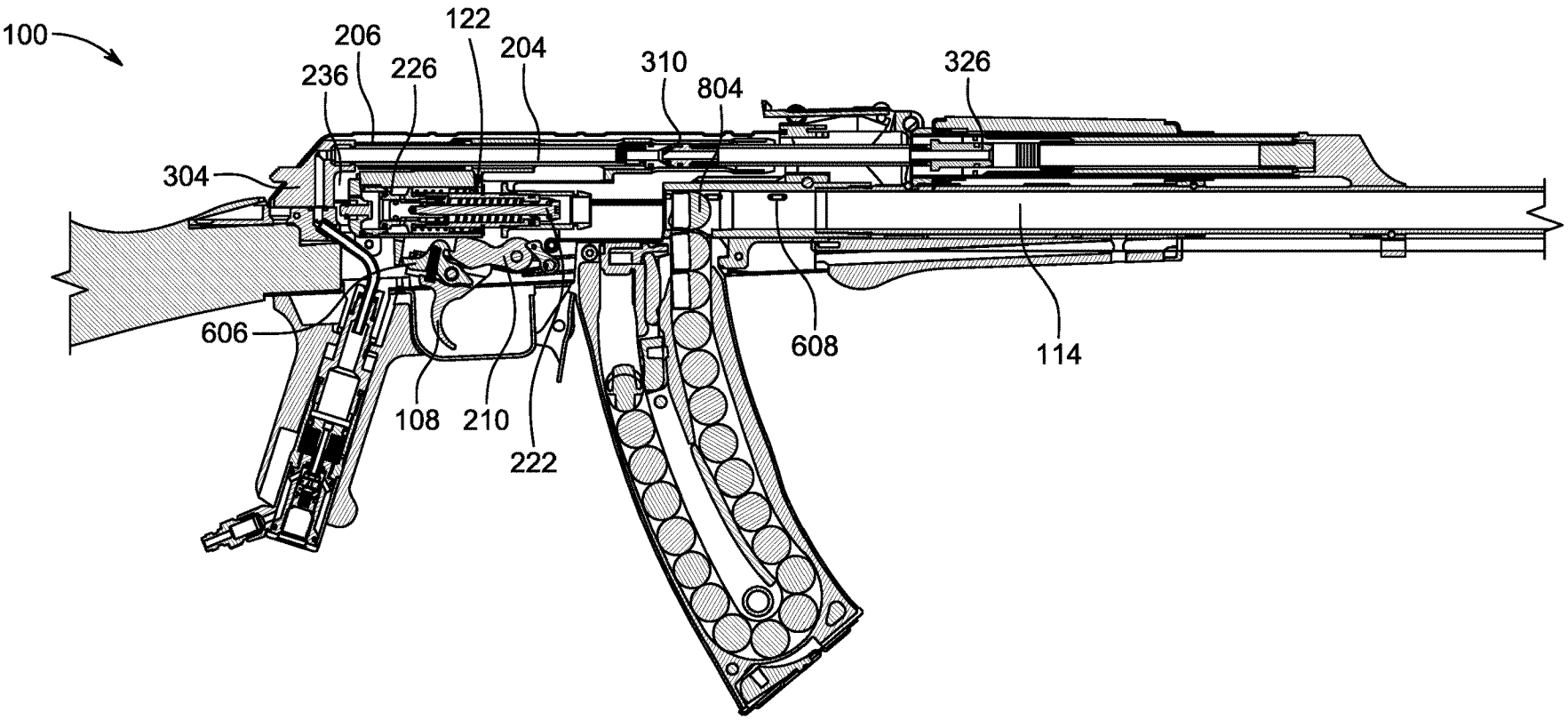

FIGS. 8A-8B illustrate a second stage of the recoiling action sequence of the air gun 100, in conjunction with FIGS. 7A-7B, according to an embodiment of the present disclosure. The second stage of the recoiling action sequence of the air gun 100 may be referred as the recoil coast stroke and may be performed in two steps, as disclosed in FIGS. 8A-8B. At first, as shown in FIG. 8A, the movement of the bolt carrier unit 122 rearwards may compress the recoil assembly spring 206 of the recoil guide tube 204, and the bolt carrier unit 122 may coast rearwards against the recoil assembly spring 206. Further, the piston 224 along with the bolt 228 may be pulled rearwards due to the rearward movement of the bolt carrier unit 122. In one embodiment, when the bolt 228 may move past a barrel feed port 802, a new projectile 804 may start entering into the barrel 114. In one embodiment, the magazine 106 may quickly feed the new projectile 804 up in position, to be fed to the barrel 114. In one embodiment, the valve pin 222 may begin to reset as the air pressure inside the valve chamber 220 may drop on both sides of the valve pin 222.

During, the rearward movement of the bolt carrier unit 122 against the recoil assembly spring 206, the hammer 210 may be fully cocked and may be retained by the disconnector 606. In one embodiment, the housing 102 may further comprise an auto sear 806, which may be fixed over a pivot. Further, the auto sear 806 may be held forward by a base of hammer 210 and may be configured to drop into a notch of the hammer 210, after the hammer 210 may be fully retained by the disconnector 606. In one embodiment, the cap 236 (or may be referred as back end of the bolt carrier unit 122) may be provided with a plurality of bleed holes 808. Further, the plurality of bleed holes 808 may be configured to vent out the compressed air inside the piston chamber 226 and consequently, pressure inside the piston chamber 226 begins to drop.

As shown in FIG. 8B, a second step of the recoil coast stroke the bolt carrier unit 122 may reach to an end of its rearward movement towards the recoil base 304, and thereby may impart a remaining momentum of its acceleration into the air gun 100. Further, the plurality of bleed holes 808 may vent out the compressed air from the piston chamber 226, and the piston 224 and the bolt 228 may be returned to their rearward positions by a maximum compression of the recoil piston return spring 218 and a maximum expansion of the valve pin spring 230. Further, as the piston chamber 226 starts venting out compressed air, the recoil piston return spring 218 may be configured to pull the piston 224 and the bolt 228 back into the bolt carrier unit 122. Further, when the bolt carrier unit 122 reaches to the end of travel, the recoil assembly spring 206 may reach to a maximum compression. In one embodiment, the bolt carrier unit 122 may reach the end of the rearward motion. In one embodiment, during the rearward movement of the piston 224 and the bolt 228 along with the bolt carrier unit 122, the new projectile 804 may be fully loaded into the barrel 114. Further, the valve pin 222 may be fully reset at this point of rearward travel of the bolt carrier unit 122.

Figure 9A:
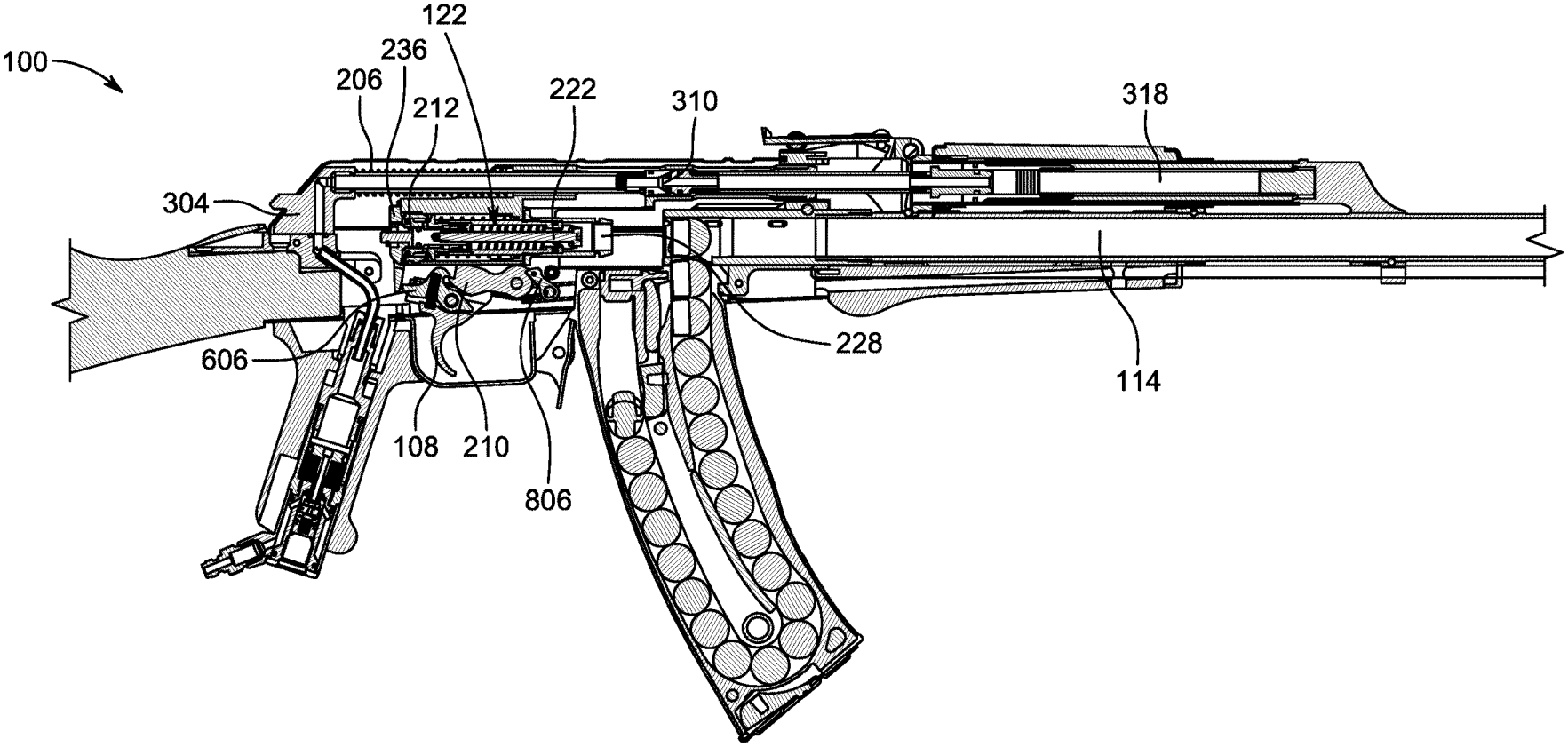
FIGS. 9A-9C illustrate the recoil stroke of the air gun, according to an embodiment of the present disclosure.
Figure 9B:
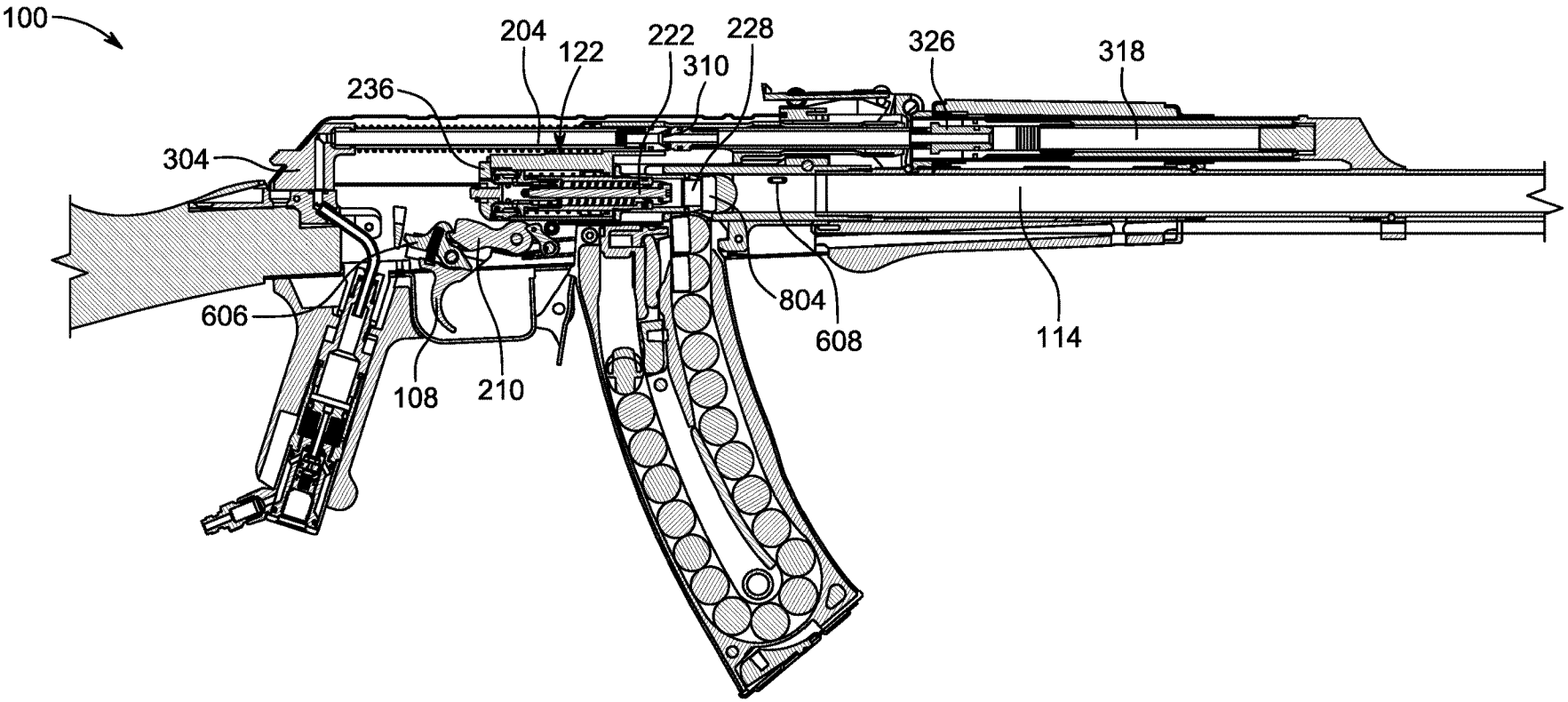
Figure 9C:
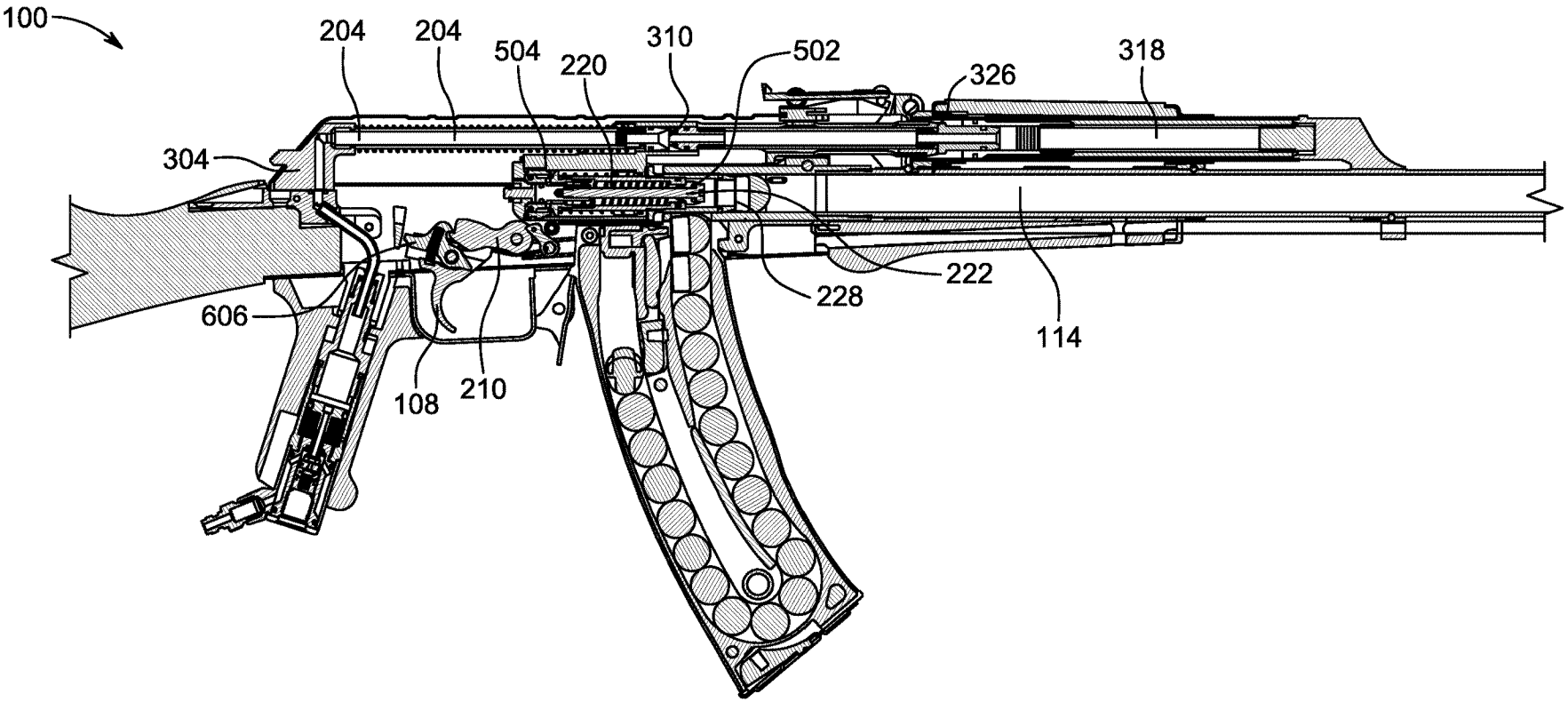

FIG. 9A-9C illustrate the return stroke of the air gun 100, in conjunction with FIG. 1, FIGS. 2A-2C, FIGS. 3A-3E, FIGS. 4A-4C, FIGS. 5A-5C, FIGS. 6A-6D, FIGS. 7A-7B, and FIGS. 8A-8B, according to an embodiment of the present disclosure. The return stroke of the air gun 100 may be performed in three stages or steps, as illustrated by FIG. 9A, FIG. 9B, and FIG. 9C respectively. As shown in FIG. 9A, after the return coast of the bolt carrier unit 122, the recoil assembly spring 206 may be at the maximal compression and therefore, under its natural state, the recoil assembly spring 206 may begin to unload tension. Further, when the recoil assembly spring 206 may begin to unload, the bolt carrier unit 122, may be pushed back forwards, towards the barrel 114. In one embodiment, the valve pin 222, the piston 224, the cap 236, and the valve pin spring 226, may be fully reset to default positions.

As shown in FIG. 9B, the recoil assembly spring 206 may continue to unload and may push the bolt carrier unit 122 towards the barrel 114. In one embodiment, the hammer 210 may no longer held in pressed stated by the bolt carrier unit 122 and may be now retained by the auto sear 804 and the disconnector 606. Further, the bolt 228 may re-enter into the barrel 114 and may begin to load the new projectile, by forcing it past the detents into the chamber of the barrel 114. In one embodiment, the piston chamber 226 may completely release the compressed air from the plurality of bleed holes 808, and the firing pin 212 may be fully reset touching the first end of the valve pin 222.

As shown in FIG. 9C, the recoil assembly spring 206 may further continue to unload and may push the bolt carrier unit 122 further forwards, such that the bolt 228 may now be inside the barrel 114, pushing the new projectile 804 past the detents of the barrel 114. In one embodiment, the first pin seal 404 may be behind the plurality of incoming air passages 504 integrated on the piston head 216. In one embodiment, the compressed air pressure from the regulator 202 may suddenly drop, as the air may be pulled from the air gun 100, in order to refill the bolt carrier unit 122. Further, the on/off shuttle 310 may be pushed forwards, and may break the seal between the conical section 322 and the tapered mating surface 324. In one embodiment, the recoil guide tube 204 may be configured to allow the compressed air to pressurize the bolt carrier unit 122 once again. Further, the on/off shuttle valve 310 breaks the seal with the recoil guide tube 204, and the air may rapidly fill in and thereby rebalance the conical section 322 and the tapered mating surface 324. In one embodiment, the first end of the bolt carrier unit 122 may impact force on the on/off shuttle valve 310 and consequently may force the on/off shuttle valve 310 forwards against holding air pressure from the recoil guide tube 204. In one embodiment, the compressed air may flow into the bolt carrier unit 122 via the ball check valve 238. Further, the compressed air may flow through the plurality of incoming air passages 504 on the piston head 216 and may start filling the valve chamber 220. In one embodiment, the bolt 228 may be moved past the barrel feed port 802 and may seal the new projectile into the chamber of the barrel 114.

Figure 10:
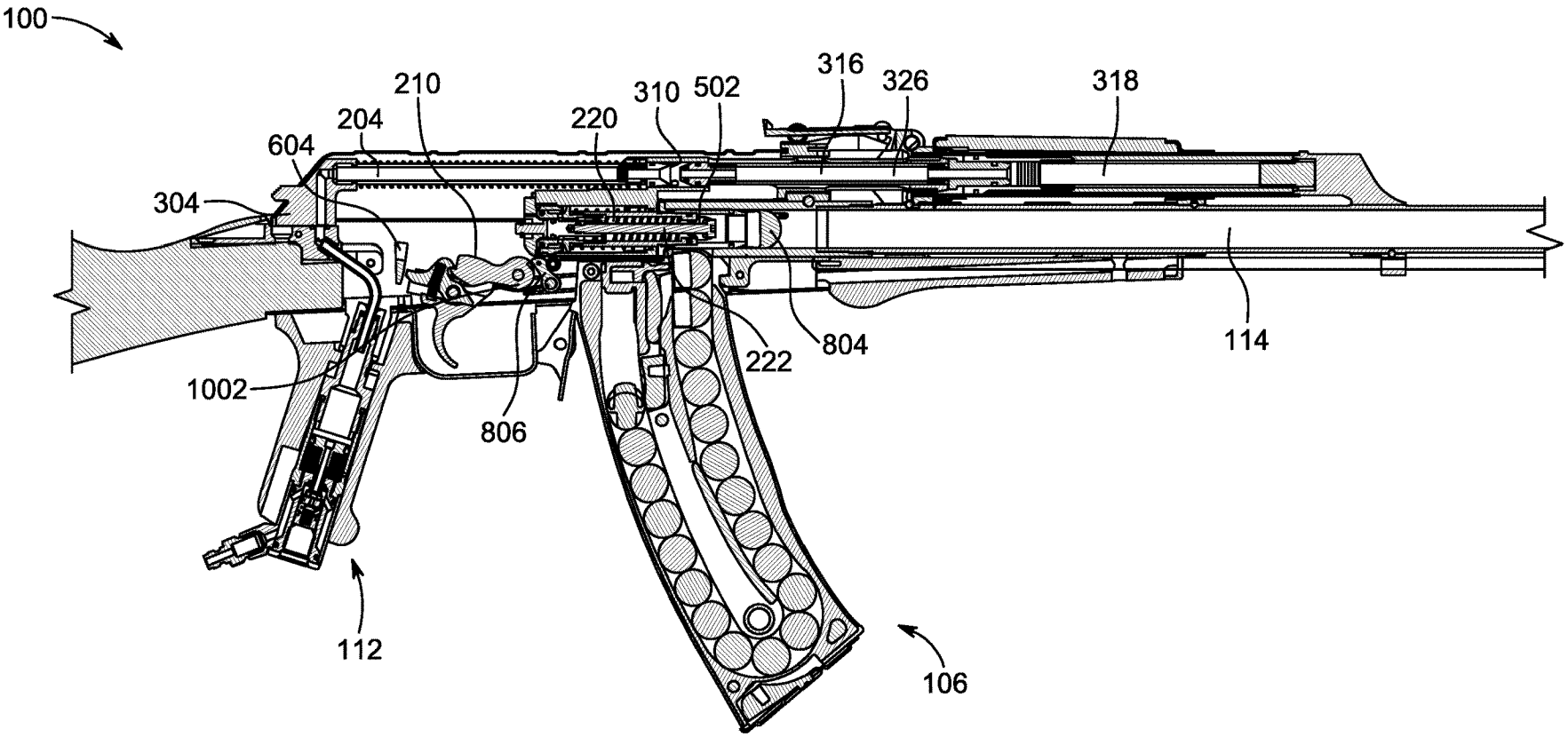
FIG. 10 illustrates a final return position of the air gun, according to an embodiment of the present disclosure.

FIG. 10 illustrates a final return position of the air gun 100, in conjunction with FIG. 1, FIGS. 2A-2C, FIGS. 3A-3E, FIGS. 4A-4C, FIGS. 5A-5C, FIGS. 6A-6D, FIGS. 7A-7B, FIGS. 8A-8B, and FIGS. 9A-9C, according to an embodiment of the present disclosure. In one embodiment, the final return position of the air gun 100 may be referred as an in-battery state. The bolt carrier unit 122 may be herein in a forward end of the travel. Further, the auto sear 806 may be provided with an arm 1002 wrapped around the pivot of the auto sear 806 and coupled at a first end with the bolt carrier unit 122 and a second end may slide down the pivot axis of hammer 210. In one embodiment, when the air gun 100 may be in semi-automatic position, the movement of the bolt carrier unit 122 towards the barrel 114, may press down the first end of the arm 1002, and second end of the arm 1002 may lift up the hammer 210. Further, during the semi-automatic position, the trigger 108 may be held to a rear and the hammer 210 may be retained by the disconnector 606. In one embodiment, the safety selector 604 may be in a ready to fire position during semi-automatic position of the air gun 100. In one embodiment, the conical section 322 may be disengaged from the tapered mating surface 324 of the recoil guide assembly 320. In one embodiment, the on/off shuttle valve 310 may be configured to deliver the compressed air into the bolt carrier unit 122. Further, the valve chamber 220 may be fully pressurized by the compressed air flowing from the plurality of incoming air passages 504. In one embodiment, the new projectile 804 loaded into the barrel 114 may be held by the detent.

Figure 11:
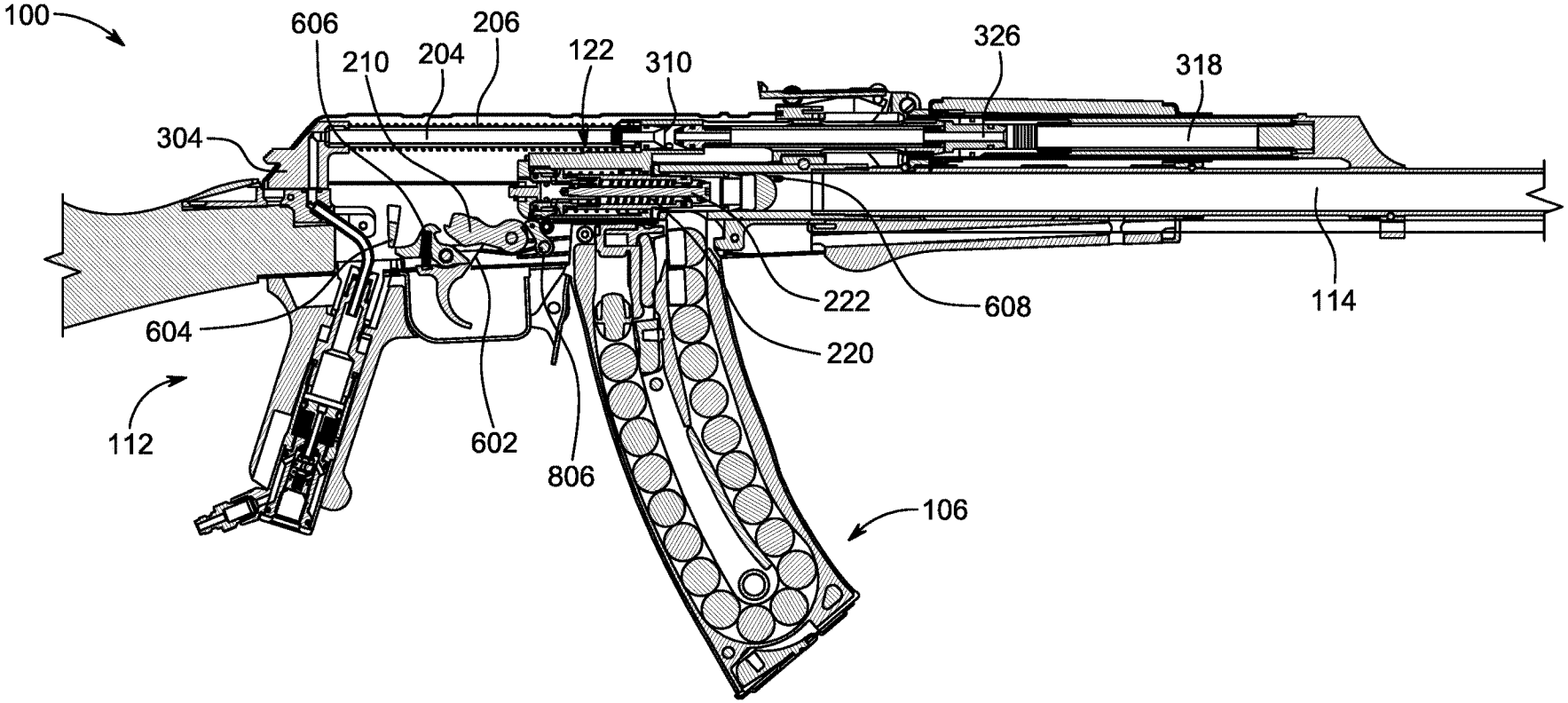
FIG. 11 illustrates a reset position of the air gun, according to an embodiment of the present disclosure.

FIG. 11 illustrates a reset position of the air gun 100, in conjunction with FIG. 1, FIGS. 2A-2C, FIGS. 3A-3E, FIGS. 4A-4C, FIGS. 5A-5C, FIGS. 6A-6D, FIGS. 7A-7B, FIGS. 8A-8B, FIGS. 9A-9C, and FIG. 10, according to an embodiment of the present disclosure. The reset position of the air gun 100 may be referred as the ready to fire position. The trigger 108 may be pulled and the disconnector 606 may release the hammer. Further, the hammer 210 may lift slightly up and may be now retained only by the hook 602 of the trigger 108. Therefore, the air gun 100 may return to the first stage of firing sequence, as described in FIG. 6A-B. In one embodiment, when the safety selector 604 of the air gun 100 may be set in full-automatic, the disconnector 606 may be held back for entire operation of the air gun 100. In another embodiment, during the full-automatic setting of the air gun 100, the hammer 210 may be swinging back forward as soon as the auto sear 806 may be pushed forward during the ready to fire position of the air gun 100. In one exemplary embodiment, the air gun 100 may be provided with a scope for shooting the projectile out of the barrel 114 towards the target in a more accurate manner.

The overall operation of the air gun 100 as herein described may be heavily derived from the commonly understood mechanisms of most modern firearms. The intent of the present invention may be to replicate the action of such firearms through the use of a compressed air supply instead of controlled explosions.

Another aspect of the present air gun 100 may be the actuation of the trigger or striker assemblies that may follow various implementations. Further, it may depend upon the specific firearms as may be the specific layout and external shape of the bolt carrier assembly and the recoil assemblies in order for the overall fit and form to match a specific firearm. An additional application area of the air gun 100 may be for military/law enforcement use, self-defense purposes, for training tools, for recreational purposes (target shooting, sport of airsoft, NERF, etc.) or for other types of activities that may include the use of similar type of air guns. Another additional application area of the air gun 100 may be to omit the firing of a projectile and use the air gun 100 for its effect of recoil and for the loud sound of firing. Such an application area may require more air pressure to increase the recoil power without the concern for projectile velocity or efficiency.

While there is shown and described herein certain specific structures illustrating various embodiments of the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

LIST OF ELEMENTS

100 Air Gun
102 Housing
104 Cover
106 Magazine
108 Trigger
110 Air inlet swivel
112 Handle
114 Barrel
116 Buttstock
118 Handguard
120 Recoil gas unit
122 Bolt Carrier Unit
124 Magazine Release Lever
126 Inner Structure
128 Outer Structure
200A Sectional View of Air Gun in Partial Recoil Position
200B Sectional View of Air Gun in Full Recoil Position
200C Sectional View of Air Gun in Rest or Forward or Ready to Fire Position
202 Regulator
204 Recoil Guide Tube
206 Recoil Assembly Spring
208 Shut-Off Valve
210 Hammer
212 Firing Pin
214 Retainer
216 Piston Head
218 Recoil Piston Return Spring
220 Valve Chamber
222 Valve Pin
224 Piston
226 Piston Chamber
228 Bolt
230 Valve Pin Spring
232 Bolt Flange
234 Recoil Tube Carrier
236 Cap
238 Ball Check Valve
302 Plug Screw

304 Recoil Base
306 Air Channel
308 Extended Hook
310 On/Off Shuttle Valve
312 Plurality of O-rings
314 Second Plurality of holes
316 Air Tube
318 Air Reservoir
320 Recoil Guide Assembly
322 Conical Section
324 Tapered Mating Surface
326 Shuttle Retainer Cap
402 Piston Body
404 First Pin Seal
406 Second Pin Seal
408 Third Pin Seal
410 First Plurality of Grooves
412 Valve Pin Sealing Surface
414 O-ring Gland
416 Forward Pin Seal O-ring
418 Second Plurality of Grooves
502 Cup Seal
504 Plurality of incoming Air passages
602 Hook of the Trigger
604 Safety Selector
606 Disconnector
608 Rubber Dent
610 Plurality of Barrel Bores
802 Barrel Feed Port
804 New projectile
806 Auto Sear
808 Plurality of Bleed Holes
1002 Arm

What is claimed is:

1. An air gun comprising:

a recoil gas unit comprising:

a recoil guide tube configured to supply compressed air;

a recoil assembly spring wrapped around the recoil guide tube, and disposed within a recoil tube carrier, for movement of the recoil tube carrier; and a bolt carrier unit coupled to the recoil gas unit, the bolt carrier unit comprising:

a piston disposed at a first end of the bolt carrier unit;

a valve chamber, wherein the valve chamber is configured to receive the compressed air, for performing a firing stroke of the air gun; and a piston chamber integrated at a second end of the bolt carrier unit, between a cap of the bolt carrier unit and the piston, wherein the piston chamber is configured to facilitate movement of the bolt carrier unit and to receive the compressed air, for performing a recoiling stroke of the air gun, wherein the recoil gas unit facilitates the compressed air to flow towards the valve chamber of the valve chamber and the piston chamber of the bolt carrier unit, to facilitate the firing stroke and the recoiling stroke of the air gun.

2. The air gun as claimed in claim 1, wherein the bolt carrier unit further comprises:

a firing pin integrated at the second end of the bolt carrier unit, and actuated by a hammer attached to a trigger of the air gun; and a retainer coupled to the cap of the bolt carrier unit and the firing pin, the retainer is configured to hold the firing pin from falling out of the bolt carrier unit.

3. The air gun as claimed in claim 1, wherein the piston comprises:

a piston head at a first end of the piston;

a valve pin coupled with the piston head, at a second end of the piston; and a valve pin spring wrapped around the valve pin, wherein the piston head is configured to remain stationary, and the valve pin is configured to move towards a barrel of the air gun to release air, after the firing stroke is completed, to compress the valve pin spring.

4. The air gun as claimed in claim 3, wherein the piston head is configured to move within the bolt carrier unit, during the firing stroke of the air gun.

5. The air gun as claimed in claim 3, wherein the second end of the piston is configured to interface with a forward end of the valve pin to seal the valve chamber.

6. The air gun as claimed in claim 5, wherein the bolt is configured to be pushed forward against the barrel, causing the bolt carrier unit to move rearwards and the bolt is configured to be pulled rearwards by a recoiling action of the bolt carrier unit.

7. The air gun as claimed in claim 3, wherein the valve chamber is configured to continuously receive the compressed air during the movement of the piston towards the barrel of the air gun, to move the valve chamber rearwards and to release a shut-off valve.

8. The air gun as claimed in claim 7, wherein the shut-off valve is disposed along a length of the recoil guide tube, and is configured to hinder the compressed air being delivered to the valve chamber.

9. The air gun as claimed in claim 1, wherein the recoil assembly spring is configured to push the bolt carrier unit forward to a resetting position, when the recoil stroke is completed.

10. The air gun as claimed in claim 9, wherein the recoil assembly spring is configured to decompress to an initial length, when the bolt carrier unit moves forward to the resetting position.

11. The air gun as claimed in claim 1, wherein the bolt carrier unit further comprises a check valve integrated on a side air passage of the bolt carrier unit, and is configured to prevent the compressed air from venting out of the valve chamber.

12. The air gun as claimed in claim 11, wherein the ball check valve is further configured to retain the compressed air within the valve chamber, when the bolt carrier unit is retracted from a forward ready to fire position.

13. The air gun as claimed in claim 1, wherein the bolt carrier unit further comprises a recoil piston return spring placed within the piston chamber, and coupled with the cap and the piston head, wherein the recoil piston return spring is configured to facilitate a recoiling action of the bolt carrier unit when the compressed air is fed into the piston chamber after the firing stroke.

14. The air gun as claimed in claim 1, wherein the cap of the bolt carrier unit is coupled with an O-ring to seal the valve chamber from ambient atmosphere.

15. The air gun as claimed in claim 2, wherein the air gun is configured for an automatic function, by recharging the hammer during a rearward movement of the bolt carrier unit at the end of the recoiling stroke.

* * * * *